US007207092B2

(12) United States Patent
Iwase et al.

(10) Patent No.: US 7,207,092 B2
(45) Date of Patent: Apr. 24, 2007

(54) SLIDER FOR SLIDE FASTENER WITH AUTOMATIC STOPPER

(75) Inventors: Yuichi Iwase, Toyama-ken (JP); Keiichi Keyaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 63 days.

(21) Appl. No.: 11/007,424

(22) Filed: Dec. 8, 2004

(65) Prior Publication Data

US 2005/0125966 A1 Jun. 16, 2005

(30) Foreign Application Priority Data

Dec. 10, 2003 (JP) ..... 2003-412422

(51) Int. Cl.
*A44B 19/26* (2006.01)

(52) U.S. Cl. ..... 24/421; 24/420; 24/419; 24/424

(58) Field of Classification Search ..... 24/420, 24/419, 424
See application file for complete search history.

(56) References Cited

U.S. PATENT DOCUMENTS 4,829,638 A * 5/1989 Ishii ..... 24/421
4,980,954 A * 1/1991 Takabatake et al. ..... 24/421
5,664,600 A * 9/1997 Palmer ..... 137/501
6,647,599 B2 * 11/2003 Lin ..... 24/421
6,654,988 B1 * 12/2003 Chung ..... 24/421

FOREIGN PATENT DOCUMENTS

| | | |
|---|---|---|
| EP | 0273324 | 7/1988 |
| EP | 0280071 | 8/1988 |
| EP | 0390186 | 10/1990 |
| JP | 4-32974 | 8/1992 |

* cited by examiner

*Primary Examiner*—Robert J. Sandy
*Assistant Examiner*—Marcus Menezes
(74) *Attorney, Agent, or Firm*—Everest Intellectual Property Law Group; Michael S. Leonard

(57) ABSTRACT

This invention relates to a slider for a slide fastener with an automatic stopper comprising front and rear mounting pillars of a slider body and a pawl body open to the rear mounting pillar and having a concave portion for accommodating a shaft portion of a pull wherein a gap portion allowing the shaft portion to pass through is formed in the concave portion by disposing the rear mounting pillar in a fitting guide groove in the slider body slidably in back and forth directions, and the shaft portion is prevented from slipping out of the concave portion through the gap portion when a pull holding body for covering the slider body is engaged with the front and rear mounting pillars, whereby simplifying a slider body's structure, an attachment structure of the pull and manufacturing procedure, and reducing a manufacturing cost while securing a stable/excellent automatic stopper function.

6 Claims, 16 Drawing Sheets

SLIDER FOR SLIDE FASTENER WITH AUTOMATIC STOPPER

BACKGROUND OF THE INVENTION

1. Field of the Invention

The present invention relates to a slider for a slide fastener having an automatic stop function and more particularly to a slider for a slide fastener with an automatic stopper which enables to simplify a structure of a slider body and also enables a pull to be easily installed on the slider body.

2. Description of Related Art

Conventionally, there has been often used a slider for a slide fastener having an automatic stop function in which by operating a pull to a slider body which couples/uncouples a zip teeth row of a fastener chain, a stop pawl of a stop pawl body is engaged with a part of the zip teeth row of the fastener chain so as to stop the slider body from moving (see for example, Japanese Utility Model Publication No. 4-32974).

In a slider 100 described in Japanese Utility Model Publication No. 4-32974, as shown in FIGS. 17 and 18, a downward concave pull holding body 102 is fixed firmly on a slider body 101 from a shoulder side of an upper blade piece to a rear opening side. The base end portion of a stop pawl body 103 is mounted near the shoulder side of the same pull holding body 102 such that it is capable of moving vertically.

An engaging pawl 105 projecting to a zip teeth row position on a fastener chain through an engagement window 104 formed in the upper blade piece of the slider body 101 such that it goes through vertically and an operation concave portion 107 which is opened to a rear opening side of the upper blade piece for accommodating the mounting shaft portion of a pull 106 are formed at a front end of the stop pawl body 103. A bottom face of the base end portion of the stop pawl body 103 is always urged by a spring force of a compression coil spring placed in a small hole formed in the upper blade piece as shown in FIG. 18 so as to project the engaging pawl 105 of the stop pawl body 103 to the zip teeth row position on the fastener chain through the engagement window 104.

As shown in FIG. 18, a gap portion 108 formed between an end portion on the side of the rear opening of the pull holding body 102 and the upper blade piece of the slider body 101 serves as a gap used for inserting the mounting shaft portion of the pull 106. A closing member 109 for closing an insertion gap is disposed in this gap portion 108 so that it is capable of sliding between a gap closing position near the rear opening side and a gap opening position near a shoulder side. The closing member 109 is always urged toward the gap closing position.

The closing member 109 is formed in a substantially U shape as seen in its plan view as shown in FIG. 17. At its two-branched arm portion, there are formed a first closing portion 110 for closing the gap portion 108 for a mounting shaft portion of the pull 106 not to be able to pass through the gap position and a second closing portion 114 for closing a continuous edge portion 113 which is continuous between a clearance 111 formed near the rear opening in right and left wall portions of the pull holding body 102 and an accommodating space 112 formed near a shoulder for the mounting shaft portion of the pull 106 not to be able to pass through. Both first and second closing portions 110, 114 project upwardly.

For the slider 100 having the above-described structure, as shown in FIGS. 18 to 20, the stop pawl body 103, the closing member 109 and the pull holding body 102 are assembled on the slider body 101 except the pull 106 as a slider assembly product and then, the pull 106 is installed on the slider assembly product.

Upon installation of the pull 106 onto the slider body 101, as shown in FIGS. 18 and 19, the mounting shaft portion of the pull 106 is pressed into the gap portion 108 in the slider body 101 as a first step. If an outside end of the first closing portion 110 of the closing member 109 is pressed with the mounting shaft portion of the pull 106, the first closing portion 110 leaves an end on the rear opening side of the pull holding body 102 as shown in FIG. 19 so that the gap portion 108 is opened widely for the mounting shaft portion of the pull 106 to be able to pass through. After the mounting shaft portion is moved from the gap portion 108 into the clearance 111 in the pull holding body 102, the closing member 109 returns to its original gap closing position by a restoration force of the spring as shown in FIG. 20.

Next, as shown in FIG. 20, the mounting shaft portion of the pull 106 is moved from the clearance 111 in the pull holding body 102 into a concave portion formed between the first and second closing portions 110 and 114 of the closing member 109 as a second step. If the mounting shaft portion of the pull 106 is pressed into the gap portion 108 again as a third step, the second closing portion 114 looses out of a position of the continuous edge portion 113 in the pull holding body 102 as shown in FIG. 19. The mounting shaft portion of the pull 106 passes the bottom end of the continuous edge portion 113 in a condition in which it is accommodated in the concave portion and moves to the bottom end of the accommodating space 112 in the pull holding body 102. At the same time, the mounting shaft portion of the pull 106 moves into an operation concave portion 107 in the stop pawl body 103 as indicated with a broken line in FIG. 19.

As a fourth step, if the pull 106 is moved upward so as to move the mounting shaft portion of the pull 106 into the accommodating space 112 in the pull holding body 102, an interference between the mounting shaft portion and the second closing portion 114 of the closing member 109 is eliminated. Consequently, the closing member 109 returns to the gap closing position due to a spring force and then, the installation of the pull 106 is completed. Then, if the closing member 109 returns to the gap closing position, the pull 106 is prevented from escaping out.

After the installation of the pull 106, if it is intended to remove the pull 106 out from the slider body 101, the closing member 109 is moved to the gap opening position against an elastic force and with the closing member 109 held at the gap opening position, a reverse operation for the pull 106 to the above-mentioned operation is carried out. Consequently, the existing pull 106 can be removed out from the slider body 101 and a new pull can be installed instead of the existing pull 106.

As for an operation with the pull 106 installed in this way, if the pull 106 is pulled obliquely upward or in a sliding direction of the slider, the stop pawl body 103 is brought up against an elastic force through the operation concave portion 107 in the stop pawl body 103 by the mounting shaft portion of the pull 106, so that the engaging pawl 105 of the stop pawl body 103 leaves the zip teeth row on the fastener chain. In this condition, the slider body 101 can be moved freely so as to mesh the zip teeth row on the fastener chain with each other. When the pull 106 is released from a hand, the stop pawl body 103 is urged by a spring so that the engaging pawl 105 is automatically inserted into the zip teeth row on the fastener chain through the engagement window 104 in the upper blade piece, thereby stopping the motion of the slider. Meanwhile the technology on the slider for the slide fastener with the automatic stopper disclosed in Japanese Utility Model Publication No. 4-32974 was previously proposed by the present inventor.

Manufacturers of clothing, bags and the like have been demanded to prepare slider bodies and various types of pulls separately so as to install the diversified types of pulls each having a different color and shape onto the slider body corresponding to a request and desire of a customer.

As a result, after an order on a slider corresponding to a request or desire of customer is received, the necessity of requesting a part manufacturer, who manufactures and sells fixing devices such as fasteners for, for example, bags, sport wears and other clothes to develop and manufacture a slider which fits to the request or desire of the customers again is eliminated, so that the manufacturers of clothing, bags and the like can meet such request or desire of the customer quickly.

According to the related art described in Japanese Utility Model Publication No. 4-32974, the pull 106 can be installed on a slider assembly product detachably in the above-described manner. However, upon installing the stop pawl body 103 and the pull holding body 102 on the slider body 101 of the conventional slider 100, it is necessary to form a shaft hole in each of a pair of mounting pieces, right and left, erected on the side of the shoulder of the slider body 101 and support the front end of the stop pawl body 103 between the respective mounting pieces so as to be vertically rotatable via a pin inserted into each shaft hole. Next, exposed end portions on both sides of the aforementioned pin are inserted into the shaft holes formed in the right and left side wall portions of the pull holding body 102 and the pull holding body 102 should be fixed on each mounting piece so that it is immobile by crimping each exposed end of the pin with respect to the right and left side wall portions of the pull holding body 102.

For the reason, the mounting structures of the stop pawl body 103 and the pull holding body 102 onto the slider body 101 become complicated. In case where the stop pawl body 103 and the pull holding body 102 are assembled on the slider body 101 using an automatic assembly machine, diversified apparatuses accompanied by that automatic assembly work are required thereby boosting its equipment cost and accompanied by an increase in the equipment cost, management cost and the like possibly increase. Further, because the mounting structures of the stop pawl body 103 and the pull holding body 102 to the slider body 101 become complicated, manufacturing cost of the slider increases, thereby making it impossible to produce at a low cost.

According to the related art described in Japanese Utility Model Publication No. 4-32974, when the closing member 109 is pressed to the gap closing position of the slider body 101 as described above, the gap portion 108 formed between an end portion on the rear opening side of the pull holding body 102 and the upper blade piece of the slider body 101 is opened. Then, the mounting shaft portion of the pull 106 is inserted through the opening portion of this gap portion 108 to below the rear face of the pull holding body 102 and further inserted into the operation concave portion 107 in the stop pawl body 103. Then, the installation of the pull 106 is completed.

However, when engaging the pull 106 with the operation concave portion 107 in the stop pawl body 103, it is necessary to move the pull 106 by amounts that allow it to go beyond top ends of sliding faces of the first and second closing portions 110, 114 of the closing member 109 while moving the closing member 109 by the pull 106 with resisting an elastic force.

As a result, if the pull holding body 102 is set large, necessarily, the size of the closing member 109 increases, so that an excessive pressing force for that closing member 109 is necessary. Because such a strong pressing force is applied directly to the first and second closing members 110, 114 of the closing member 109 and the stop pawl body 103, damage, deformation and the like are likely to occur in the closing member 109, the stop pawl body 103 and the pull 106, thereby worsening the assembly performance for the pull 106 and the slider body 101.

On the other hand, when removing an existing pull 106 from the slider assembly product, it is necessary to move the closing member 109 to a gap opening position resisting an elastic force so as to release an engagement between the pull 106 and the operation concave portion 107 in the stop pawl body 103. By executing a reverse operation to the operation for engaging the pull 106 with the operation concave portion 107 in the stop pawl body 103 with the closing member 109 held at the gap opening position resisting an elastic force of the closing member 109, it is necessary to pull out the pull 106 while moving it by the amounts which allows it to go beyond the top faces of the respective sliding faces of the first and second closing portions 110, 114. For the reason, the mounting work for the pull 106 becomes complicated like a case where the pull 106 is engaged with the operation concave portion 107 in the stop pawl body 103.

The slider for the slide fastener with the automatic stopper described in Japanese Utility Model Publication No. 4-32974 is so constructed that its pull 106 can be replaced with a new pull different in color or shape by pulling out the pull 106 from the slider assembly product. Thus, the slider structure is complicated as described above and there is a limit in installing the pull on the slider assembly product accurately and thus, the installation work of the pull has been demanded to be facilitated. If such a demand can be satisfied, the pull can be installed on the slider body reasonably.

SUMMARY OF THE INVENTION

Accordingly, the present invention has been achieved to solve the conventional problems and an object of the present invention is to provide a slider for a slide fastener with an automatic stop function, which enables a structure of its slider body to be simplified, its manufacturing cost to be reduced, and further a pull to be installed easily while securing such a stable and excellent automatic stop function.

To achieve the above-described object, according to a main aspect of the present invention, there is provided a slider for a slide fastener with an automatic stopper comprising: a slider body for engaging/disengaging a zip teeth row of a fastener chain; mounting pillars provided on a top face of the slider body; a pawl body which is mounted on the top face of the slider body such that it is capable of swinging vertically and engages and disengages a part of the zip teeth row in the fastener chain through the inside of the slider body; a concave portion which is formed in the pawl body and opened to one of the mounting pillars for accommodating a shaft portion of a pull; a pull holding body which engages with the mounting pillars, engaging portions provided on the mounting pillars; and engaged portions to be engaged with the engaging portions provided on the pull holding body, wherein a gap portion which allows a shaft portion of the pull to pass through is formed between an opening end of the concave portion and the mounting pillar, the mounting pillars or the pull holding body has closing means for closing a part of the gap portion and preventing the pull from escaping from the opening end of the concave portion.

Preferably, the mounting pillars and the pull holding body have lateral moving preventing means for preventing the pull holding body from moving in right and left directions relative to the slider body, and the lateral moving preventing means comprises supporting walls erected on right and left edges of the mounting pillars and wall portions of the pull holding body fit and supported between the right and left supporting walls.

Further preferably, the mounting pillars comprise a front mounting pillar provided on a front portion of the slider body and a rear mounting pillar on a rear portion of the slider body, the pull holding body comprises the wall portions constituted of a top wall portion, front and rear wall portions extending from front and rear ends of the top wall portion, and the front and rear wall portions comprise the engaged portions.

Preferably, the closing means comprises right and left wall portions projecting downward from right and left sides of the top wall portion of the pull holding body and when the pull holding body is engaged with the mounting pillars, the right and left wall portions cover and close the gap portion.

Preferably, pull guide faces for guiding a shaft portion of the pull are formed in the right and left wall portions respectively.

Preferably, the closing means comprises the mounting pillar and the mounting pillar is disposed slidably to an opening end of the concave portion and closes the gap portion at a position close to the opening end of the concave portion while a positioning portion for positioning the mounting pillar at the position close to the opening end is formed on the slider body.

Further Preferably, a fitting guide groove for guiding the mounting pillar in its fitting condition are formed in the top face of the slider body while fitting portions which are fit to the fitting guide groove are formed on the mounting pillar.

The slider for the slide fastener with the automatic stopper of the present invention has a first prominent feature in that the engaging portions are formed in the mounting pillars of the slider body and that the engaged portions capable of being engaged with the engaging portions on the mounting pillars can be formed on the pull holding body.

The slider of the present invention has a second prominent feature in that during an assembly process before the pull holding body is mounted on the slider body over the pawl body after the pawl body which is engaged with and disengaged from a part of the zip teeth row on the fastener chain through the inside of the slider body is installed on the slider body such that it is capable of swinging vertically, the gap portion which allows the shaft portion of the pull to pass through can be formed between the mounting pillar and the concave portion in the pawl body.

Further the slider of the present invention has a third prominent feature in that after the shaft portion of the pull is inserted into the concave portion in the pawl body through the gap portion, the closing means for closing at least a part of the gap portion and preventing the pull from escaping from the opening end of the concave portion in the pawl body can be formed in the mounting pillars or the pull holding body. "Closing a part of the gap portion" mentioned in the description about the first aspect of the present invention and this specification means narrowing the interval in the gap portion to a very small one.

According to the present invention, the pull holding body can be held in an immobile condition and firmly to the mounting pillars of the slider body. Thus, after the pawl body is installed on the top face of the slider body and then the shaft portion of the pull is mounted in the concave portion in the pawl body movably through the gap portion, the pull holding body can be engaged with the mounting pillars from above the pawl body and the pull. Consequently, the shaft portion of the pull can be blocked from escaping out from the opening end of the concave portion in the pawl body through the gap portion securely.

Further, with a simple structure, the gap portion can be formed between the opening end of the concave portion in the pawl body and the mounting pillar and at least a part of the gap portion can be closed by the pull holding body. Further, the shaft portion of the pull and the pawl body can be actuated smoothly and securely in a space portion formed between a rear face of the pull holding body and the top face of the slider body. As a consequence, damage, improper deformation and trouble of the pawl body can be prevented thereby improving its durability.

The slider can be manufactured with a simple structure without a necessity of providing the slider body with any special closing member or complicated structure as described in Japanese Utility Model Publication No. 4-32974. Upon installation of the pull on the top face of the slider body, the pawl body, the pull and the pull holding body can be assembled in order on the top face of the slider body. Consequently, the assembly performance and reliability can be improved considerably and tractability is high.

Further, the pull and the pull holding body can be assembled appropriately onto the slider body loaded with the pawl body as a complete slider product. The assembly can be carried out not only with an automatic assembly machine but also easily and securely with man power. Upon installation of the pull on the top face of the slider body, a simple processing apparatus may be employed without a necessity of any special accessory equipment or peripheral machine. As a consequence, processing cost is reduced and productivity can be improved, thereby manufacturing cost of the slider being reduced.

Because the pull holding body can be fit to the mounting pillars and installed firmly and securely, the pull holding body does not have to be formed in any complicated configuration, but a simple rectangular plate-like structure, for example, may be adopted for the pull holding body. As a consequence, reductions in size and thickness of the slider can be achieved. Further, an installation positions of the engaging portions of the mounting pillars are not restricted to any special position, and the engaging portions may be formed on a front face of the front mounting pillar and a rear face of the rear mounting pillar, for example.

As the engaging portions on the mounting pillars, which are applied to the present invention, it is permissible to use for example, engaging concave portions, cutouts, hole portions, protrusions or the like. As the engaged portions of the pull holding body, it is permissible to adopt elastic pieces, pawls or the like which are engaged with the engaging portions in the mounting pillars. If the engaging portions of the mounting pillars themselves have elastic structures, the engaged portions of the pull holding body may be formed in a structure or configuration such as a simple protrusions having stiffness.

According to the present invention, the mounting pillars and the pull holding body can be provided with lateral moving preventing means for preventing themselves from moving relatively to the right or left side. As a typical structure of the lateral moving preventing means, the lateral moving preventing means can be constructed with the supporting walls erected on the right and left edges of the mounting pillars, and the wall portions of the pull holding body. The top wall portion and front and rear wall portions at the front and rear ends of the pull holding body can be fit to and supported between the right and left supporting walls of the mounting pillars.

The pull holding body can be prevented from moving in back and forth directions and further, the mounting pillars and pull holding body can be maintained in an immobile state with the lateral moving preventing means. As a consequence, even if a strong force intending to release an engagement between the engaging portions of the mounting pillars and the engaged portions of the pull holding body is applied according to the operation of the pull, a holding force to the pull holding body can be increased without distorting the pull holding body in the back and forth directions, right and left directions, obliquely or in a vertical direction.

The lateral moving preventing means may be formed on the top faces of the mounting pillars and an opposing face of the pull holding body to the mounting pillars and may be a protrusion or a concave portion which if fitted to each other. In this case, the lateral moving preventing means can be constructed of the protrusions formed on the top faces of the mounting pillars or the opposing face of the pull holding body to the mounting pillars and the concave portions formed on the other one of the top faces of the mounting pillars and the opposing face of the pull holding body to the mounting pillars.

Fixing areas of the slider body and the pull holding body can be secured without exposing any special fixing structure outside the slider body and the pull holding body. Further, by setting the protrusion and the concave portion which are the lateral moving preventing means appropriately at positions on which a pulling force of the pull is likely to act, a strong holding force for the pull holding body can be obtained, and the gap portion and the closing means can be set reasonably.

When the engaged portions of the pull holding body is engaged with the engaging portions of the mounting pillars, the supporting walls of the mounting pillars are fit to the wall portions of the pull holding body, so as to support and fix the pull holding body firmly and securely. Despite such a simple structure in which the supporting walls are fit to the wall portions of the pull holding body, both of the pull holding body and the respective pillars are integrated with each other so that they are not separable, thereby improving the assembly performance and reliability or the like remarkably. Therefore, the pull holding body does not have to be constructed in any complicated structure, and it is permissible to adopt a simple horizontal C shape for the pull holding body. Consequently, reductions in size and thickness of the slider can be achieved and tractability is high.

Further, at least the wall portions of the pull holding body are fit between the opposing faces of the right and left supporting walls of the mounting pillars, so that the pull holding body can be disposed flush with the top face of the respective mounting pillars. At the same time, the thickness thereof can be reduced, thereby reductions in weight and size of the slider being achieved. Consequently, a slider excellent in appearance design and having a high value as a product is produced effectively.

As a typical structure of the closing means of the present invention, the right and left wall portions projecting downward from right and left sides of the top wall portion of the pull holding body can be constructed as the closing means, like the embodiment of the third aspect. The right and left wall portions of the pull holding body project into a space formed between a rear face of the pull holding body and the top face of the slider body when the pull holding body is engaged with the mounting pillars. Consequently, the right and left wall portions cover and close the gap portion between the opening end of the concave portion in the pawl body and the mounting pillars.

According to the above-described structure, if the pull is raised upward, the shaft portion of the pull makes contact with the right and left wall portions, thereby limiting a distance of an upward movement of the shaft portion of the pull. Thus, the pull can be prevented from escaping out from the opening end of the concave portion in the pawl body. Further, it is possible to secure a function which allows the pawl portion of the pawl body to engage with and disengage from a part of the zip teeth row on the fastener chain without generating an excessive deformation in the pawl body.

The right and left wall portions can be provided with a pull guide face for guiding the shaft portion of the pull as mentioned in the fourth aspect of the invention. When the pull holding body is engaged with the mounting pillars, the shaft portion of the pull can be positioned securely and a swing of the pawl body can be carried out smoothly and easily by operating the pull. Because no excessive deformation is caused in the pawl body, the pawl body can be restored to its original state smoothly and securely and the function of the pawl body can be secured for a long time.

As another typical structure example of the closing means of the present invention, the closing means can be constructed with a mounting pillar, like the fifth aspect of the invention. This mounting pillar can be constructed to be fit to the top face of the slider body and capable of sliding thereon between a position where the gap portion which allows the shaft portion of the pull to pass through is closed and a position where the gap portion is formed. Thus, when mounting the pull over the top face of the slider, the gap portion can be formed as a required gap.

With the above-described structure, the gap portion can be closed with the mounting pillar at a position where the mounting pillar is approached with a predetermined gap with respect to the opening end of the concave portion when the mounting pillar is slid on the top face of the slider body and then, the mounting pillar can be positioned by the positioning portion. Consequently, the shaft portion of the pull can be inserted into the concave portion in the pawl body accurately and stably, thereby achieving a highly stabilized and excellent assembly performance. After the shaft portion of the pull is mounted in the concave portion in the pawl body, the pull holding body can be engaged with the mounting pillars at the position of which the mounting pillar approaches.

As a structure for sliding the mounting pillar with respect to the top face of the slider body, a fitting guide groove for guiding the mounting pillar in the fitting condition can be formed in the top face of the slider body, like the sixth aspect of the invention, and the fitting portion which is fitted to the fitting guide groove can be formed on the mounting pillar.

With the above-described structure, the fitting guide groove can be formed along the top face of the slider body toward the opening end of the concave portion in the pawl body. Thus, the mounting pillar can be guided accurately and stably toward the pawl body and further, mounted simply and accurately.

A sufficient attachment strength of the slider body and the mounting pillar can be secured without exposing any special attachment structure outside of the slider body and the mounting pillar. Further, by setting the protrusion and concave portion appropriately at positions which allow the mounting pillar to slide easily, a strong holding force of the mounting pillar to the slider body can be obtained. In the meantime, the fitting guide groove in the slider body and the fitting portion on the mounting pillar may be a protrusion or a concave portion which is fitted to each other, for example, a protrusion formed in the fitting guide groove and a concave portion formed in the fitting portion.

DESCRIPTION OF THE PREFERRED EMBODIMENTS

Hereinafter the preferred embodiments of the present invention will be described with reference to the accompanying drawings.

Figure 1:
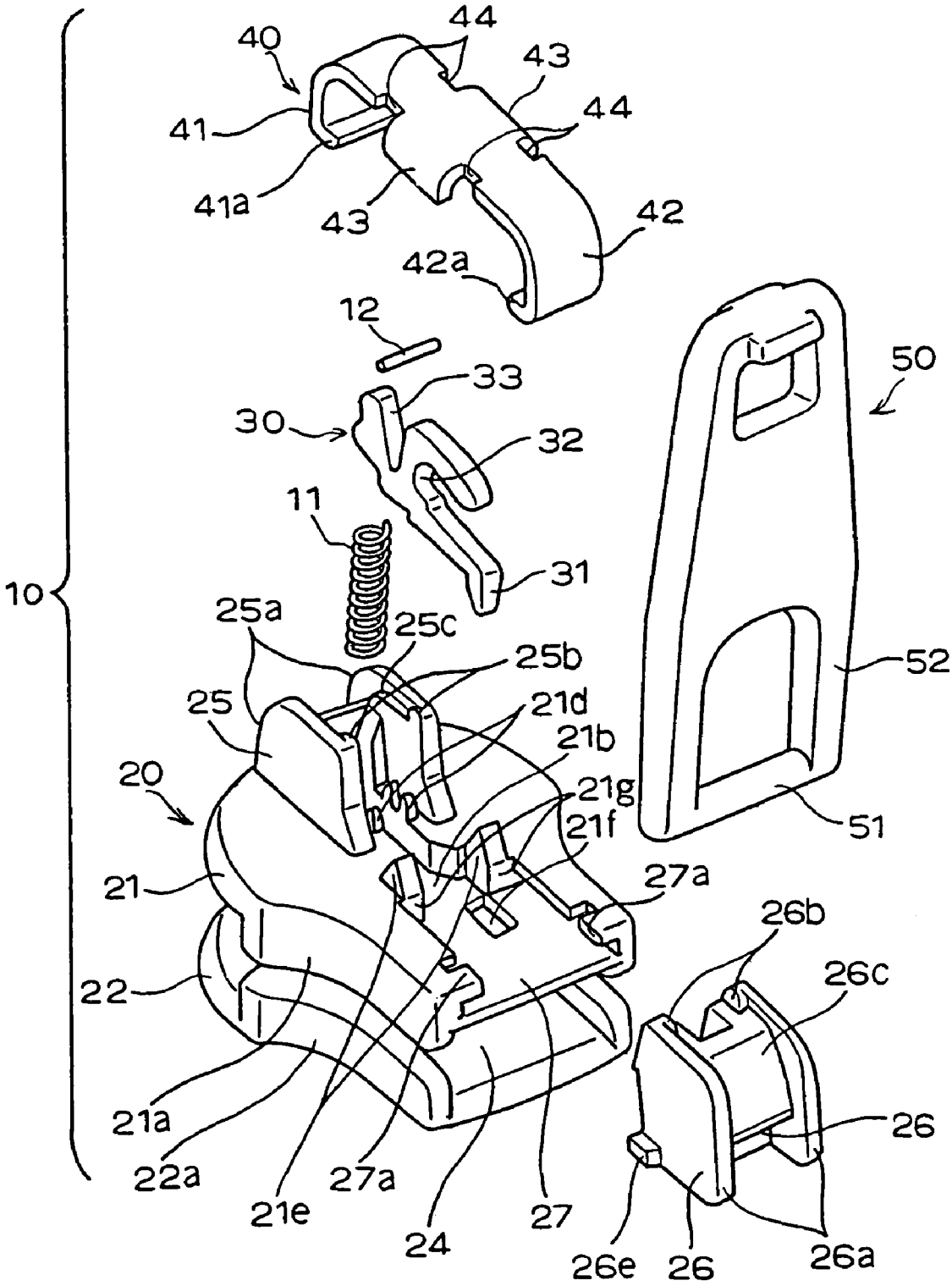
FIG. 1 is a perspective view showing a state in which components constituting a slider for a slide fastener with an automatic stopper of the present invention are disassembled (first embodiment)
Figure 7:
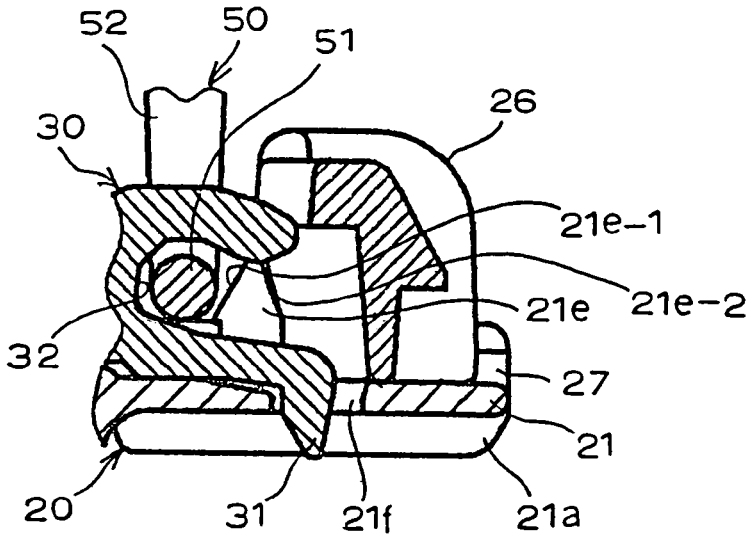
FIG. 7 is a longitudinal sectional view of major portions showing a next assembly step to that of FIG. 6 (first embodiment)
Figure 8:
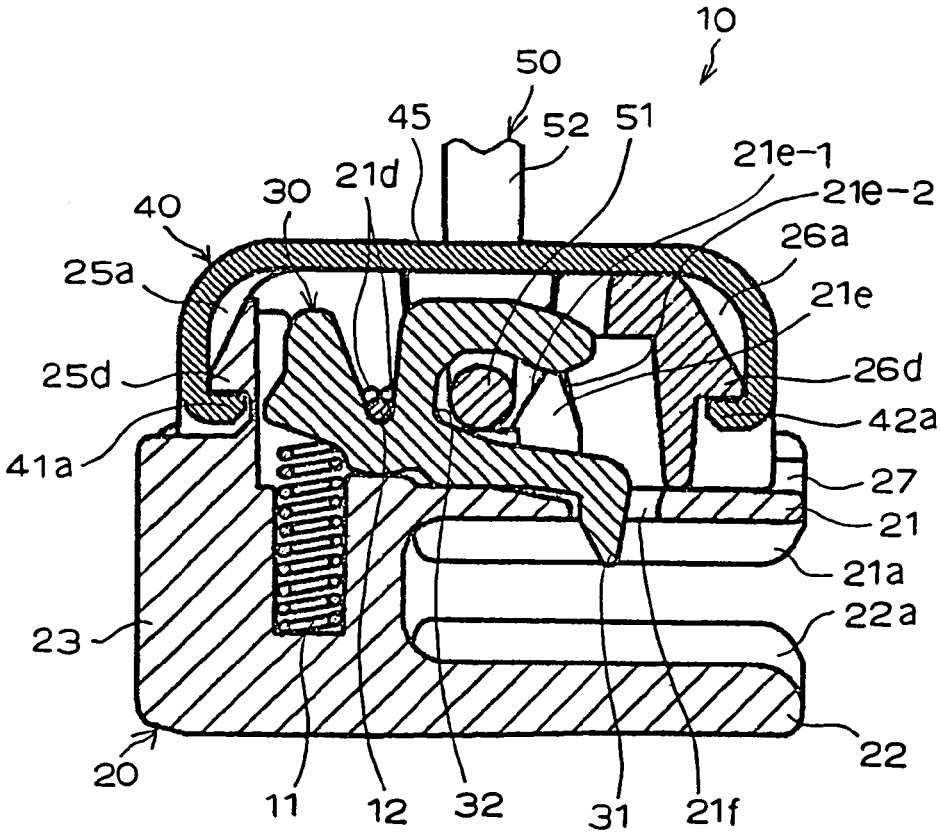
FIG. 8 is a longitudinal sectional view of major portions showing a next assembly step to that of FIG. 7 (first embodiment)
Figure 9:
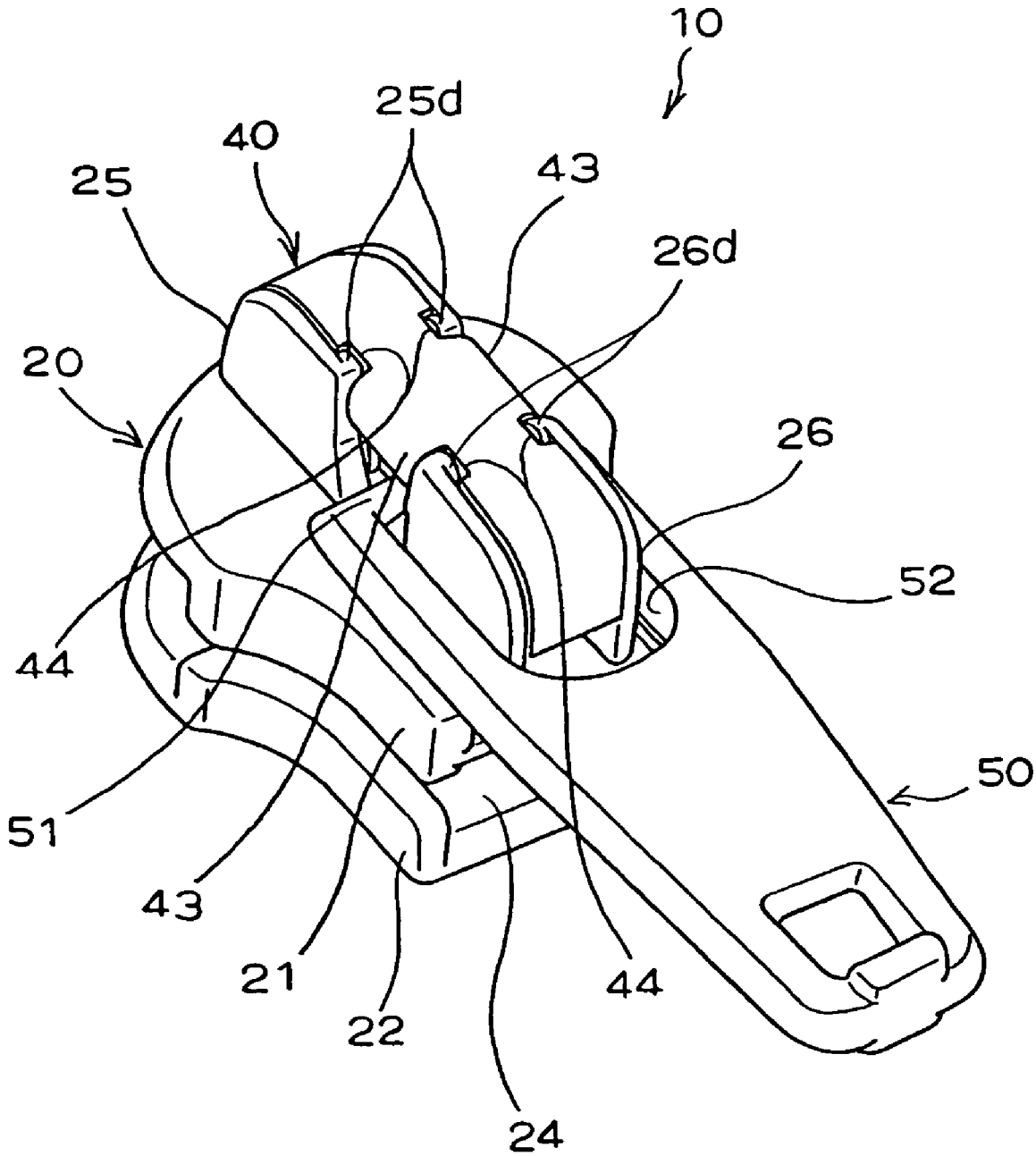
FIG. 9 is a perspective view of the same slider (first embodiment)

FIGS. 1 to 9 show a typical first embodiment of the present invention. FIG. 1 is a perspective view showing a state in which components constituting a slider for a slide fastener with an automatic stopper are disassembled, FIGS. 2 to 8 are longitudinal sectional views of major portions showing assembly steps of the same slider, and FIG. 9 is a perspective view of the same slider. In this embodiment, a side of a shoulder (left side in FIG. 1) of the slider is called as a front portion while a side of a rear opening (right side in FIG. 1) of the slider is called as a rear portion.

First Embodiment

Referring to FIG. 1, the slider for the slide fastener with the automatic stopper 10 comprises a slider body 20, a front mounting pillar 25, a rear mounting pillar 26, a pawl body 30, a pull holding body (cover body) 40, a pull 50 and the like. The pawl body 30 and the pull holding body 40 can be manufactured by press molding using metallic material such as stainless and/or copper alloy. On the other hand, the slider body 20, the front mounting pillar 25, the rear mounting pillar 26 and the pull 50 can be manufactured by die-cast molding using metallic material such as aluminum alloy and zinc alloy. In the meantime, these members can be manufactured by injection molding using thermoplastic resin such as polyamide, polypropylene, polyacetal, polybutylene terphthalate and the like or thermoplastic resin material added with wear resistant reinforcing material, instead of metal materials.

Figure 2:
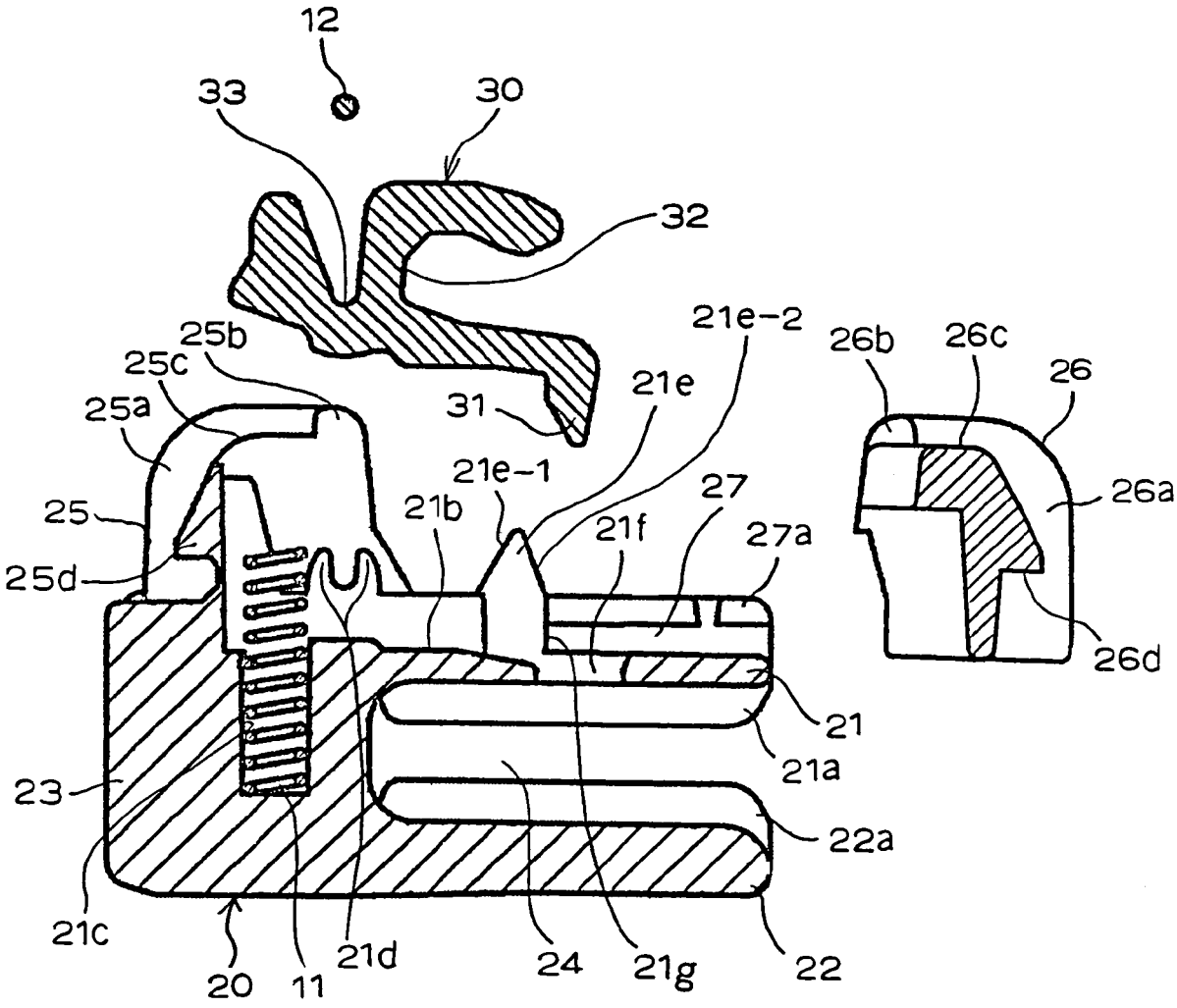
FIG. 2 is a longitudinal sectional view of major portions showing an assembly step of the slider (first embodiment)

As shown in FIG. 2, the slider body 20 comprises an upper blade piece 21, a lower blade piece 22 and a connecting pillar 23 for connecting front end portions of the upper and lower blade pieces 21, 22. The upper and lower blade pieces 21, 22 have upper and lower flanges 21*a*, 22*a* respectively on the right and left sides from a rear end to substantially a central portion. A Y-shaped engaging element guide path 24 is formed between the upper and lower blade pieces 21 and 22.

As shown in FIG. 1, the front mounting pillar 25 having a typical structure of the present invention is formed integrally with a top face of the front portion of the upper blade piece 21 of the slider body 20 such that it stands upright therefrom. This front mounting pillar 25 comprises a pair of front supporting walls 25*a*, 25*a* separated with an interval corresponding to an outer shape of the pull holding body 40. As shown in FIGS. 1 and 2, a step portion 25*c*, is formed in each of the opposing faces of the front supporting walls 25*a* so that the step portion is lowered only by a predetermined depth from a top edge while a projecting portion 25*b* is left at a rear end corner. A step face of the step portion 25*c* is formed as a contact face for the pull holding body 40 in order to prevent it from invading further when the pull holding body 40 is fitted between the front supporting walls 25*a*. A top face of the projecting portion 25*b* is disposed at substantially the same height as a top face of the pull holding body 40 when the pull holding body is fitted.

A linear engaging portion 25*d*, which extends between right and left side faces as shown in FIG. 2, is formed integrally with front opposing faces of the front supporting walls 25*a*. This engaging portion 25*d* is formed in a step-like shape comprising a guide slope face which is inclined downward smoothly along the step face of each of right and left step portions 25*c* and an edge engaging face which engages with/disengages from the pull holding body 40.

As shown in FIGS. 1 and 2, a pawl accommodating concave portion 21*b* extended longitudinally is formed in the central portion of the top face of the upper blade piece 21 between the opposing faces of the front supporting walls 25*a* as a mounting face for the pawl body 30. As shown in FIG. 2, a spring accommodating hole 21*c* is made in a central portion at a front end of a bottom face of this pawl accommodating concave portion 21*b*. A compression coil spring 11 for urging the pawl portion 31 of the pawl body 30 to make the pawl portion 31 project into the engaging element guide path 24 after an installation of the pawl body 30 is accommodated within the spring accommodating hole 21*c*.

A pair of right and left pawl mounting portions 21*d*, 21*d* are integrally formed on the top face of the upper blade piece 21 between rear opposing faces of the front supporting walls 25*a* such that they project upward adjacent both side edges of the pawl accommodating concave portion 21*b*. A top face of each of the pawl mounting portions 21*d* is divided into two branches. A gap in the pawl mounting portion 21*d* is constructed as a pin supporting hole for a pin 12 for supporting the pawl body 30 so that it is capable of swinging vertically. The pin 12 is fixed on the top face of the upper blade piece 21 by crimping the two branches of the pawl mounting portion 21*d* after the pawl body 30 is mounted as shown in FIG. 3.

As shown in FIGS. 1 and 2, a short base piece and a long piece of flat plate materials are formed integrally at front and rear end portions of the pawl body 30. As shown in FIG. 3, a supporting concave portion 33 for supporting the pawl body 30 by the pin 12 supported and fixed by the pawl mounting portion 21*d* is formed between the base piece and the long piece. This supporting concave portion 33 is formed into a desired depth and shape which enable the pin 12 to support the pawl body 30. A bottom face of a base end of the pawl body 30 is constructed to act as a mounting face which is mounted on the compression spring 11. A concave portion 32, which is open to the rear mounting pillar 26 for accommodating a shaft portion 51 of the pull 50, is formed at a front end of the pawl body 30. The pawl portion 31, which engages with engaging elements of a slide fastener (not shown) so as to stop the slider body 20 from moving, is formed integrally on the bottom face at the front end of the pawl body 30 such that it is bent downward.

A first prominent feature of the slider 10 of the present invention exists in that as shown in FIG. 8, engaging portions 25*d*, 26*d* are formed on the paired mounting pillars 25, 26 and that engaged portions 41*a*, 42*a* which is engaged with the engaging portions 25*d*, 26*d*, can be formed on the pull holding body 40.

Figure 3:
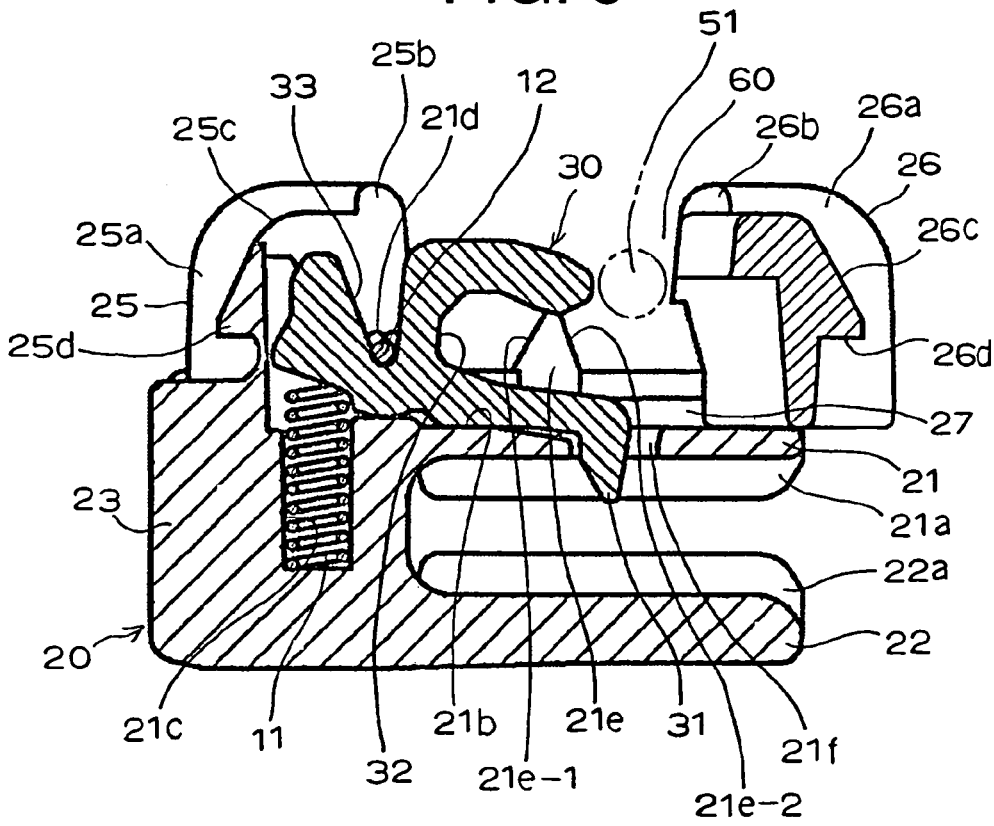
FIG. 3 is a longitudinal sectional view showing a next assembly step to that of FIG. 2 (first embodiment)

A second prominent feature of the present invention exists in that a gap portion 60 for the shaft portion 51 of the pull 50 to pass through is formed between the rear mounting pillar 26 and the pawl body 30 during an assembly step before the pull holding body 40 is mounted on the top face of the upper blade piece 21 after the pawl body 30 is mounted on the top face of the upper blade piece 21 so that it is capable of swinging vertically as shown in FIG. 3.

Further a third prominent feature of the present invention exists in that when the pull holding body 40 is engaged with the respective mounting pillars 25, 26 as shown in FIG. 8, it is possible to form closing means which partially closes the gap portion 60 (FIG. 3) and prevents the pull 50 from escaping from an opening end of the concave portion 32 in the pawl body 30. "Partially closing the gap portion 60" mentioned here means narrowing an interval of the gap portion 60 to a very small extent.

According to the first embodiment, an initial object of the present invention can be achieved by constructing the rear mounting pillar 26, which is fitted to a rear top face of the upper blade piece 21, so that it is capable of sliding. The rear mounting pillar 26 indicating a typical structure example of the present invention has a pair of right and left rear supporting walls 26*a*, 26*a* set to a same width as the front mounting pillar 25 as shown in FIGS. 1 and 2. A step portion 26*c* which is lowered by a predetermined depth from a top edge while a projecting portion 26*b* is left at a front end corner is formed on each of opposing faces of the supporting walls 26*a*. A step face of the step portion 26*c* is formed as a contact face for the pull holding body 40. A concave portion, which forms a part of an operating space of the pawl body 30, is formed at a front face of the rear mounting pillar 26.

A linear engaging portion 26*d* is formed integrally such that it extends between right and left side faces on opposing faces near rear ends of the rear supporting walls 26*a*. The engaging portion 26*d* is constructed in a step-like shape comprising a guide slope face which is inclined downward smoothly along a surface of the step portion 26*c* and an edge engaging face which engages with/disengages from the pull holding body 40. The structure of the rear mounting pillar 26 is not substantially different from that of the front mounting pillar 25 except that it is constructed so as to be capable of sliding with respect to the upper blade piece 21.

Figure 4:
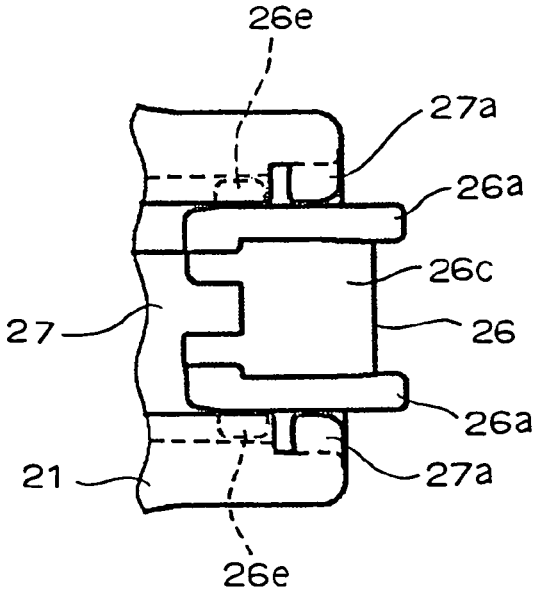
FIG. 4 is a plan view of major portions for explaining the assembly of a rear mounting body of the slider (first embodiment)

A fitting guide groove 27, in which a bottom end portion of the rear mounting pillar 26 is inserted and fitted, can be formed in a top face of a rear portion of the upper blade piece 21. This fitting guide groove 27 is formed to have grooves having a substantially U shaped section on its right and left sides while it extends from the rear end to substantially the central portion of the upper blade piece 21 as shown in FIGS. 1 and 2. As shown in FIGS. 1 and 4, rectangular protrusions which are fitting portions 26*e*, 26*e*, fitted to the fitting guide groove 27, are formed so as to project from parts of the rear supporting walls 26*a*, 26*a* of the rear mounting pillar 26. (Hereinafter each of the fitting portions 26*e* are referred to as a protrusion 26*e*.) In the meantime, the fitting guide groove 27 in the upper blade piece 21 and the protrusion 26*e* of the rear mounting pillar 26 may be formed to a protrusion or a concave portion which is fitted to each other and it is needless to say that, for example, a protrusion formed in the fitting guide groove 27 and a concave portion formed in the rear mounting pillar 26 can be used and the present invention is not restricted to the example represented here.

Front end faces intersecting the pawl body accommodating portion 21*b* in the fitting guide groove 27 can be constructed as positioning portions 21*g* for the rear mounting pillar 26 that prevent the rear mounting pillar 26 from invading further when it is fitted into the fitting guide groove 27 as shown in FIGS. 1 and 2. In the meantime, the requirement condition for a positioning portion 21*g* is to position the rear mounting pillar 26 at such a position that after the shaft portion 51 of the pull 50 is mounted in the concave portion 32 of the pawl body 30, enables the respective mounting pillars 25, 26 and the pull holding body 40 to be engaged with each other while closing the gap portion 60. It is needless to say that, for example, the positioning portion 21*g* can be formed within the fitting guide groove 27 or at a predetermined position on the top face of the upper blade piece 21.

Figure 5:
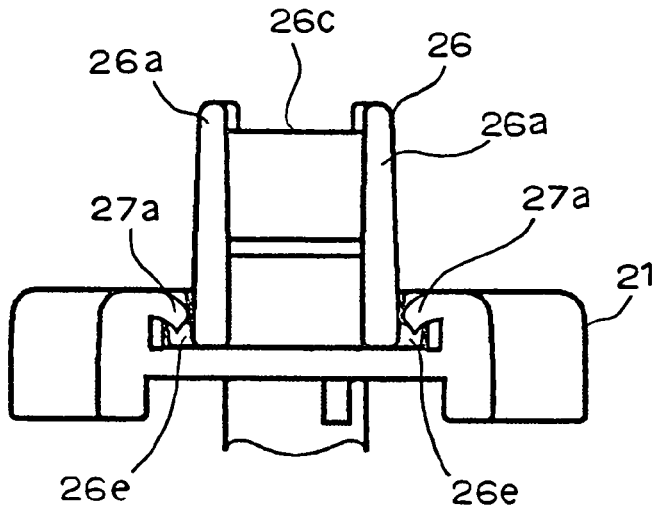
FIG. 5 is a longitudinal sectional view of major portions showing a next assembly step to that of FIG. 3 (first embodiment)

As shown in FIGS. 4 and 5, a concave cutout portion having a concave step is formed inward from an end face of an upper holding piece of the fitting guide groove 27 and slip-out preventing portions 27*a*, 27*a* are formed through the concave cutout portions. After the protrusions 26*e* of the rear mounting pillar 26 are fit to the fitting guide groove 27, the slip-out preventing portions 27*a* can be deformed elastically by crimping with respect to the top face of the upper blade piece 21 according to a normal method. Consequently, a stopper portion which prevents the rear mounting pillar 26 form escaping out can be formed. In the meantime, the slip-out preventing portion 27*a* can be formed at a predetermined position of the top face of the upper blade piece 21 instead of being formed within the fitting guide groove 27.

As shown in FIG. 3, the fitting guide groove 27 extends from the rear end of the upper blade piece 21 toward the concave portion 32 in the pawl body 30 in a condition in which the pawl body 30 is mounted on the upper blade piece 21. Consequently, the rear mounting pillar 26 can be introduced and guided accurately and stably toward the opening end of the concave portion 32 in the pawl body 30 after the pawl body 30 is mounted on the top face of the upper blade piece 21, thereby realizing an excellent assembly performance ensuring a high stability.

As a result, due to the fitting guide groove 27 and the protrusions 26*e*, fixing areas of the slider body 20 and the rear mounting pillar 26 can be secured without exposing any special fixing structure outside the slider body 20 and the rear mounting pillar 26. Consequently, the fitting guide groove 27 and the protrusions 26*e* can be set up appropriately at a portion which allows the rear mounting pillar 26 to slide easily and a firm holding force for the rear mounting pillar 26 with respect to the slide body 20 can be obtained.

When the rear mounting pillar 26 is mounted on the top face at the rear portion of the upper blade piece 21, the rear mounting pillar 26 can be set at positions where the gap portion 60 allowing the shaft portion 51 of the pull 50 to pass between the rear mounting pillar 26 and the pawl body 30 is closed as shown in FIG. 7 and where the gap portion 60 is formed as shown in FIG. 3. At the position where a rear end portion of the rear mounting pillar 26 makes contact with the slip-out preventing portion 27*a*, a maximum gap which allows the shaft portion 51 of the pull 50 to pass through can be secured sufficiently in the gap portion 60. On the other hand, the pull holding body 40 can be engaged with the respective mounting pillars 25, 26 at a position where the gap portion 60 is closed.

When mounting the rear mounting pillar 26 onto the top face of the rear end of the upper blade piece 21, it is possible to employ an automatic machine thereby improving the assembly work of the slider 10 efficiency. A predetermined gap is provided between the front mounting pillar 25 and the rear mounting pillar 26, so that the pawl body 30 and a part of the pull 50 are accommodated and a sufficient space for accommodating the pull holding body 40 can be formed.

As shown in FIGS. 1 and 2, a pair of sheet-like right and left pull guide pieces 21*e*, 21*e* are formed integrally at corners in which the fitting guide groove 27 and the pawl body accommodating concave portion 21*b* intersect each other substantially in the central portion of the upper blade piece 21 such that they project upward substantially in triangular shapes as seen in a side view. Each pull guide piece 21*e* is disposed on the upper blade piece 21 which transverses the concave portion 32 in the pawl body 30 in a condition in which the pawl body 30 is mounted on the upper blade piece 21 as shown in FIG. 3. Further, a rectangular pawl hole portion 21*f*, through which the pawl portion 31 of the pawl body 30 is inserted and removed, is formed adjacent a rear base end of the pull guide piece 21*e* such that it pierces the upper blade piece 21 vertically within the fitting guide groove 27. The pawl hole portion 21*f* communicates with the engaging element guide path 24.

As shown in FIG. 3, the concave portion 32 in the pawl body 30 mounted in the pawl accommodating concave portion 21*b* in the upper blade piece 21 is always urged downward by a spring force of the compression coil spring 11 in a condition in which it strides between the pull guide pieces 21*e*. Thus, the pull guide piece 21*e* can be constructed as a stopper portion for preventing the shaft portion 51 of the pull 50 from escaping from the concave portion 32 in the pawl body 30 in cooperation with a downward urging force of the pawl body 30 in a condition in which the shaft portion 51 of the pull 50 is mounted in the concave portion 32 of the pawl body 30 before the gap portion 60 is closed by the rear mounting pillar 26.

Figure 6:
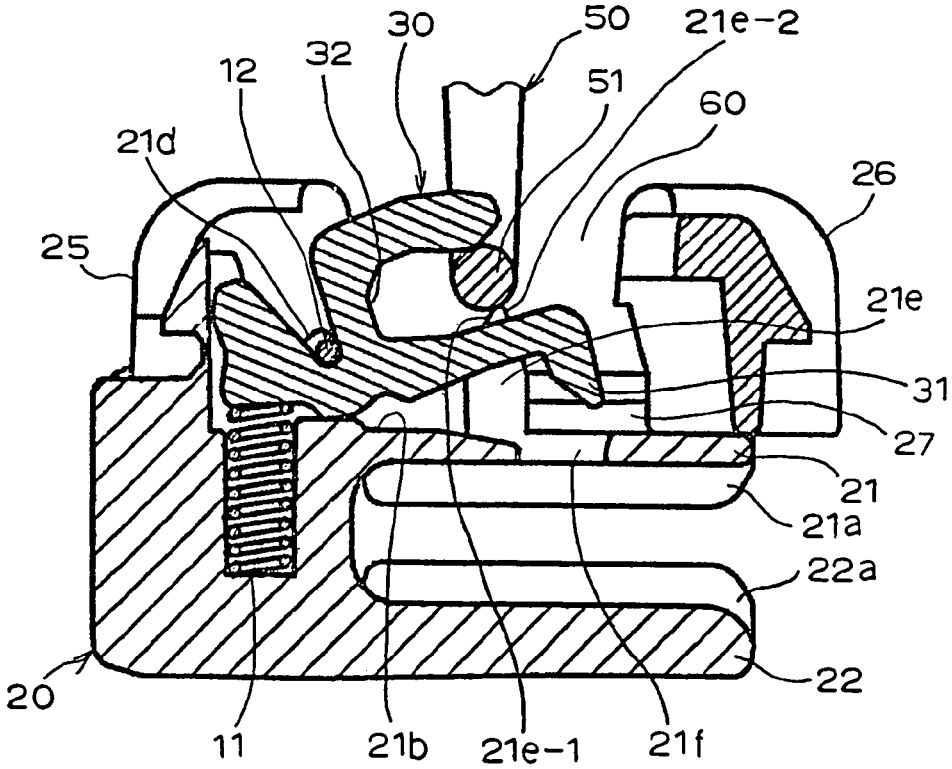
FIG. 6 is a longitudinal sectional view of major portions showing a next assembly step to that of FIG. 5 (first embodiment)

A rear end face of the pull guide piece 21*e* can be constructed as a pull guide face 21*e*-2 for guiding the shaft portion 51 of the pull 50 toward an opening end of the concave portion 32 along its tapered face which is inclined upward gradually in a forward direction when mounting the shaft portion 51 of the pull 50 in the concave portion 32 of the pawl body 30 before an operation for closing the gap portion 60 with the rear mounting pillar 26 as shown in FIG. 6. A front end face of the pull guide piece 21*e* is also constructed as a pull guide face 21*e*-1 for guiding the shaft portion 51 of the pull 50 toward the concave portion 32 along its tapered face which is inclined upward gradually in a backward direction when mounting the shaft portion 51 of the pull 50 in the concave portion 32 of the pawl body 30 as shown in FIG. 2. Further, the front end face of the pull guide piece 21*e* can be made to function as the pull guide face 21*e*-1 for guiding the pull 50 from a front base end of the pull guide piece 21*e* toward a moving limit position of the pawl body 30 when operating the pull 50 after the slider 10 is assembled as shown in FIG. 8.

Further according to the present invention, it is permissible to provide the respective mounting pillars 25, 26 and the pull holding body 40 with lateral moving preventing means in order to prevent the respective mounting pillars 25, 26 and the pull holding body 40 from moving relatively in the lateral direction. The lateral moving preventing means can be constructed with the supporting walls 25*a*, 26*a* erected on the right and left ends of the respective mounting pillars 25, 26 and a top wall portion 45 and front and rear wall portions 41, 42 at front and rear ends of the pull holding body 40. By fitting the respective wall portions 41, 42 among the respective supporting walls 25*a*, 25*a* and 26*a*, 26*a*, the pull holding body 40 can be maintained in an immobile condition with respect to the respective mounting pillars 25, 26.

As shown in FIG. 1, the pull holding body 40 is composed of a thin long plate material. The pull holding body 40 is constructed of a substantially horizontal C shaped cover body having front and rear wall portions 41, 42 projecting downward from a flat top wall portion 45 so as to be curved smoothly with the same curvature before and after the top wall portion 45. Engaged portions 41*a*, 42*a* which are elastically engaged with/disengaged from edge engaging faces of the engaging portions 25*d*, 26*d* of the respective mounting pillars 25, 26 project from inner faces at front ends of the wall portions 41, 42.

Right and left wing pieces, which are right and left wall portions 43, 43 partially covering a space portion between the front mounting pillar 25 and the rear mounting pillar 26 for shielding, project to right and left sides of the upper wall portion of the pull holding body 40. (Hereinafter each of the right and left wall portions 43 is called as a wing piece 43.) Upper faces of the right and left wing pieces 43 are curved downward with the same curvature so as to form a convex curved face. Lacking portions 44, which fit and engage with each pair of projecting portions 25*b*, 26*b* of the front mounting pillar 25 and the rear mounting pillar 26, are formed at ridge line portions (corners) between the right and left wing pieces 43 and the upper wall portion. The lacking portions 44 are formed in a stepped shape which is concave inward from both linear side end faces of the right and left wing pieces 43.

The right and left wing pieces 43 can be formed in a substantially same length as an interval between the front mounting pillar 25 and the rear mounting pillar 26 and shorter than a vertical length of each of the front and rear wall portions 41, 42. Thus, when the pull holding body 40 is mounted on the slider body 20, bottom end faces of the right and left wing pieces 43 keep apart from the top face of the upper blade piece 21, thereby forming a space portion which allows the shaft portion 51 of the pull 50 to move.

A space surrounded by a rear face of the pull holding body 40 and the top face of the upper blade piece 21 acts as an operation space portion which allows the shaft portion 51 of the pull 50 and the pawl body 30 to be operated when the pull holding body 40 is engaged with the slider body 20. In this operation space portion, the shaft portion 51 of the pull 50 and the pawl body 30 can be operated smoothly and securely. Further, the pawl body 30 can be protected from a damage, improper deformation, a trouble and the like, thereby improving its durability.

With the above-described structure, the top wall portion 45 and the front and rear wall portions 41, 42 of the pull holding body 40 is fitted and supported between the opposing faces of the supporting walls 25*a*, 26*a* of the front and rear mounting pillars 25, 26, so that a top face of the top wall portion 45 and top faces of the front and rear wall portions 41, 42 can be made flush with top faces of the supporting walls 25*a*, 26*a*. For the reason, the pull holding body 40 can be formed in a minimum thickness of necessary level and reduction in size and thinning in the structure of the slider 10 can be achieved. Further it is possible to obtain a slider highly valuable as a product and excellent in its appearance design.

The engaged portions 41*a*, 42*a* of the pull holding body 40 is engaged with the engaging portions 25*d*, 26*d* of the front and rear mounting pillars 25, 26 elastically and the pull holding body 40 is accommodated between the pairs of supporting walls 25*a*, 26*a* of the front and rear mounting pillars 25, 26 while the lacking portions 44 in the pull holding body 40 fit the paired projecting portions 25*b*, 26*b* on the front mounting pillar 25 and the rear mounting pillar 26.

Because the pull holding body 40 is fitted between the supporting walls 25*a*, 26*a* of the respective mounting pillars 25, 26 while the lacking portions 44 in the pull holding body 40 are fit to the projecting portion 25*b*, 26*b* on the mounting pillars 25, 26, the pull holding body 40 is installed firmly and securely without oscillating with respect to any force in back and forth directions and width direction. As a result, after the pawl body 30 is mounted on the top face of the slider body 20 and the shaft portion 51 of the pull 50 is mounted movably within the concave portion 32 in the pawl body 30 through the gap portion 60, the pull holding body 40 can be engaged with the respective mounting pillars 25, 26 over the pawl body 30 and the pull 50. Consequently, the shaft portion 51 of the pull 50 can be prevented from escaping from the opening end of the concave portion 32 in the pawl body 30 through the gap portion 60 securely, so that the pawl body 30 can be held smoothly and securely thereby securing the quality of the slider 10 for a long term.

The lateral moving preventing means which can be applied to the present invention may be formed on a top face of each of the mounting pillars 25, 26 and an opposing face of the pull holding body 40 to the respective mounting pillars 25, 26 and needless to say, it may be a protrusion or a dented portion which is fitted to each other. By setting a protrusion or a dented portion (not shown) at a portion on which a pulling force of the pull 50 acts easily, a holding force of the pull holding body 40 can be obtained strongly, so that the gap portion 60 and the closing means can be set up appropriately. As an example, it is possible to construct the lateral moving preventing means with a protrusion formed either on the top faces of the respective mounting pillars 25, 26 or opposing faces of the pull holding body 40 to the mounting pillars 25, 26, and a dented portion formed on the other one of the top faces of the mounting pillars 25, 26 and the opposing faces of the pull holding body 40 to the mounting pillars 25, 26.

As the engaging portions 25*d*, 26*d* of the respective mounting pillars 25, 26 which are applied to the present invention, for example, an engagement concave portion, a cutout portion, a hole portion, a protrusion and the like can be used. As the engaged portions 41*a*, 42*a* of the pull holding body 40, it is possible to adopt an elastic piece, a pawl and the like which is engaged with the engaging portions. If the engaging portions themselves have an elastic structure, the engaged portions may be formed into a structure or configuration of mere protrusions having stiffness.

Although the pull holding body 40 shown here is structured with a cover body made of a thin long sheet material, the present invention is not restricted to this example. It is permissible to employ, for example, a rectangular box comprising a top wall, front and rear wall portions, and right and left wall portions with a cutout at a center. Further, installation positions of the engaging portions 25*d*, 26*d* on the mounting pillars 25, 26 are not restricted to any particular one, however, if for example, a pull holding body 40 is constructed with a rectangular box, engaging portions can be formed on right and left side faces of front and rear mounting pillars.

The pull 50 is constructed with a short sheet material as shown in FIG. 1. This pull 50 has a ring-like grip portion at an end thereof and a ring-like holding portion 52 having a substantially square hole portion to which the rear mounting pillar 26 can be fit at the other end side. A front end portion of the ring-like holding portion 52 is formed in a shape of a bridge as the shaft portion 51 having a circular section. A length of the shaft portion 51 is set to be larger than a width of the rear mounting pillar 26 and when the pull is mounted, the shaft portion 51 is guided by the pull guide piece 21*e* of the upper blade piece 21 while striding over the rear mounting pillar 26, thereby being inserted.

Next, an example of assembly procedure of the slider 10 of the present invention will be described with reference to FIGS. 2 to 9.

To assemble the slider 10 constructed as mentioned above, as shown in FIG. 2, first of all, the compression coil spring 11 is accommodated in the spring accommodating hole 21*c* in the upper blade piece 21. Next, the pawl body 30 is placed on the pawl body accommodating concave portion 21*b* in the upper blade piece 21 in a substantially vertical posture while pressing the compression coil spring 11 with the base end of the pawl body 30 to deform it elastically. Next, the pin 12 is inserted so as to stride over the pin supporting hole in each pawl body mounting portion 21*d* of the upper blade piece 21 and the supporting concave portion 33 in the pawl body 30 and then, the two branch portions of the pawl body mounting portion 21*d* is crimped so as to fix the pin 12.

At this time, the pawl portion 31 of the pawl body 30 is inserted into the pawl hole portion 21*f* in the upper blade piece 21 and the pawl body 30 is disposed on the top face of the upper blade piece 21 in a condition in which it is entirely inclined upward from the pawl hole portion 21*f* toward the front mounting pillar 25. The base end portion of the pawl body 30 is disposed between the opposing faces of the supporting walls 25*a* of the front mounting pillars 25 in a condition in which it is always urged by the compression spring 11.

After the pawl body 30 is mounted on the top face of the upper blade piece 21 such that it is capable of swinging vertically, the protrusions 26*e* of the rear mounting pillar 26 are inserted into the fitting guide groove 27 in the upper blade piece 21. At this time, the gap portion 60, which allows the shaft portion 51 of the pull 50 to pass, can be formed between the rear mounting pillar 26 and the pawl body 30 as shown in FIG. 3. By deforming the slip-out preventing portions 27*a* of the fitting guide groove 27 plastically, the rear mounting pillar 26 can be prevented from escaping out from the rear end of the upper blade piece 21.

The gap portion 60 at a position where the rear end portion of the rear mounting pillar 26 makes contact with the slip-out preventing portion 27*a* has a maximum interval which allows the shaft portion 51 of the pull 50 to pass through between the rear mounting pillar 26 and the pawl body 30 as described above. Therefore, the rear mounting pillar 26 can be slid along the fitting guide groove 27, so that it can be located at a position where the gap portion 60 is closed and at a position where the gap portion 60 is opened and whereby the gap portion 60 can be closed with the rear mounting pillar 26.

Now, the shaft portion 51 of the pull 50 is placed in the gap portion 60 as shown in FIG. 3. Then, when the shaft portion 51 of the pull 50 is slid from a bottom end of the pull guide face 21*e*-2 of the pull guide piece 21*e* on a side of the rear mounting pillar 26 to a top end thereof as shown in FIG. 6, the concave portion 32 of the pawl body 30 is lifted. At this time, the base end of the pawl body 30 presses and elastically deforms the compression coil spring 11 with the pin 12 in the pawl mounting portion 21*d* as a swinging center and then, the concave portion 32 of the pawl body 30 swings upward against an elastic force of the compression coil spring 11. If the shaft portion 51 of the pull 50 surpasses a top end of the pull guide piece 21*e* against the elastic force of the compression coil spring 11, it is inserted into the opening end of the concave portion 32 in the pawl body 30.

If the shaft portion 51 of the pull 50 is inserted into the opening end of the concave portion 32 in the pawl body 30, the shaft portion 51 of the pull 50 is slid downwardly along the pull guide face 21*e*-1 of the pull guiding piece 21*e* at a side of the front mounting pillar 25. When the pull 50 is slid, the base end of the pawl body 30 swings upward by the elastic force of the compression coil spring 11 with the pin 12 as the swinging center, and the concave portion 32 of the pawl body 30 swings downward with the pin 12 as the swinging center.

At the same time when the shaft portion 51 of the pull 50 passes the front base end of the pull guide piece 21*e*, the compression coil spring 11 is returned elastically to its original state with the pin 12 as a swing center. At this time, the pawl portion 31 of the pawl body 30 is automatically inserted into the pawl hole portion 21*f* in the upper blade piece 21 and the shaft portion 51 of the pull 50 is accommodated in the concave portion 32 of the pawl body 30 as shown in FIG. 7. Consequently, the shaft portion 51 of the pull 50 can be prevented from escaping out of the concave portion 32 of the pawl body 30 even before the gap portion 60 is closed by the rear mounting pillar 26, because the pull guide piece 21*e* exists on a forward side of the slider with respect to the opening end of the concave portion 32 in the pawl body 30.

Next, the rear mounting pillar 26 is moved toward the front mounting pillar 25 along the fitting guide groove 27 in the upper blade piece 21 and brought into a contact with the positioning portions 21*g*. With this condition, the ring-like holding portion 52 of the pull 50 is inserted striding the rear mounting pillar 26 so as to place the pull 50 entirely in a substantially horizontal state. By bringing the rear mounting pillar 26 into a contact with the positioning portion 21*g*, the gap portion 60 is partially narrowed and then closed. At this gap closing position, the shaft portion 51 of the pull 50 can be prevented from escaping from the opening end of the concave portion 32 in the pawl body 30.

Next, as shown in FIG. 8, the pull holding body 40 is fitted into the front and rear mounting pillars 25, 26 over the pawl body 30 and the pull 50. When the pull holding body 40 is fitted into the front and rear mounting pillars 25, 26, the engaged portions 41*a*, 42*a* of the pull holding body 40 slide along the guide slope face of the engaging portions 25*d*, 26*d* of the front and rear mounting pillars 25, 26 while deforming elastically in an expanding direction and the engaged portions 41*a*, 42*a* pass a front end slop faces of the guide slope faces. At the same time, the engaged portions 41*a*, 42*a* of the pull holding body 40 are restored elastically in a contraction direction, so that the engaged portions 41*a*, 42*a* are engaged with the edge engaging faces of the engaging portions 25*d*, 26*d*.

At an insertion limit position of the pull holding body 40, the lacking portions 44 in the pull holding body 40 fit and engage with the respective projecting portions 25*b*, 26*b* on the front and rear mounting pillars 25, 26 as shown in FIG. 9. When the top wall portion of the pull holding body 40 is accommodated in the front and rear mounting pillars 25, 26, the top wall portion of the pull holding body 40 is kept flush with the top end faces of the front and rear mounting pillars 25, 26. The bottom end faces of the right and left wing pieces 43, 43 of the pull holding body 40 shield and close a part of the operation space portion for operating a part of the pull 50 and the pawl body 30 in a state in which they are apart from the top face of the upper blade piece 21. Consequently, the assembly of the slider 10 is completed.

Despite such a simple structure in which the engaged portions 41*a*, 42*a* of the pull holding body 40 are caught by the engaging portions 25*d*, 26*d* of the front and rear mounting pillars 25, 26, the gap portion 60 can be partially narrowed and closed when the pull holding body 40 is engaged with the slider body 20. Further, this structure can be constructed as closing means for preventing the shaft portion 51 of the pull 50 from escaping out from the opening end of the concave portion 32 in the pawl body 30.

When the pull holding body 40 is fixed by engagement, the pawl body 30 and the pull 50 are integrated with each other so that they are not separable, thereby considerably improving the assembly performance and reliability and ensuring tractability. When mounting the pull 50 on the top face of the slider body 20, the pull 50 and the pull holding body 40 can be assembled in order after the pawl body 30 is mounted on the top face of the slider body 20. Thus, the pull 50 can be assembled on the top face of the slider body 20 after the pawl body 30 is mounted thereon by combinations of various kinds of shapes and colors and this assembly can be performed easily and stably by man power or with an automatic assembly machine. It is not necessary to provide the slider body 20 with any special structure member or associate complicated structure. Consequently, the slider 10 can be manufactured with a simple structure and manufacturing cost of the slider 10 can be reduced.

For example, it is possible to prepare a slider body 20 loaded with a pawl body 30 and various types of pulls 50 and pull holding bodies 40 having different shapes or colors suitable for the slider body 20 separately. Consequently, after an order according to a request or a desire of a customer is received, various types of the pulls 50 can be installed on the slider body 20 mounting the pawl body 30. As a result, components of the slider can be used effectively and the slider 10 having highly versatility is obtained so as to intensify the value of the slider 10 as a product.

When releasing an engagement between the pawl portion 31 of the pawl body 30 and the engaging elements (not shown), first of all, the pull 50 assembled in parallel to the slider body 20 as shown in FIG. 9 is lifted up with a hand. Then the shaft portion 51 of the pull 50 rises along the pull guide face 21*e*-1 on the side of the front mounting pillar 25 of the pull guide piece 21*e*. As the pull 50 rises, the pawl body 30 swings forward with the shaft portion 51 of the pull 50 as a swinging center. When the pawl body 30 swings, the base end portion of the pawl body 30 presses and elastically deforms the compression coil spring 11 in a direction for releasing the engagement of the pawl portion 31 with an engaging element (not shown). When the shaft portion 51 of the pull 50 moves to the moving limit position of the pawl body 30, the pawl portion 31 departs from the engaging element through the pawl hole portion 21*f* in the upper blade piece 21 as shown in FIG. 8, thereby releasing the engagement.

Upon a releasing operation, the slider 10 can move freely to the side of the shoulder or the rear opening of the slider 10. By moving the slider 10 freely, a zip teeth row (not shown) of a fastener chain can be engaged with each other or released to the right and left. If the pull 50 is released from the hand after this desired operation is completed, the pawl body 30 swings backward due to an elastic force of the compression coil spring 11. When the pawl body 30 swings, the shaft portion 51 of the pull 50 descends along the pull guide face 21*e*-1 of the pull guide piece 21*e* and is restored to its original state elastically. At this time, the pawl portion 31 of the pawl body 30 is automatically inserted between the zip teeth row of the fastener chain through the pawl hole portion 21*f* in the upper blade piece 21. Consequently, the pawl portion 31 of the pawl body 30 engages with the engaging element. With this engagement condition, the slider 10 is prevented from moving further and kept stopped.

Second Embodiment

Figure 10:
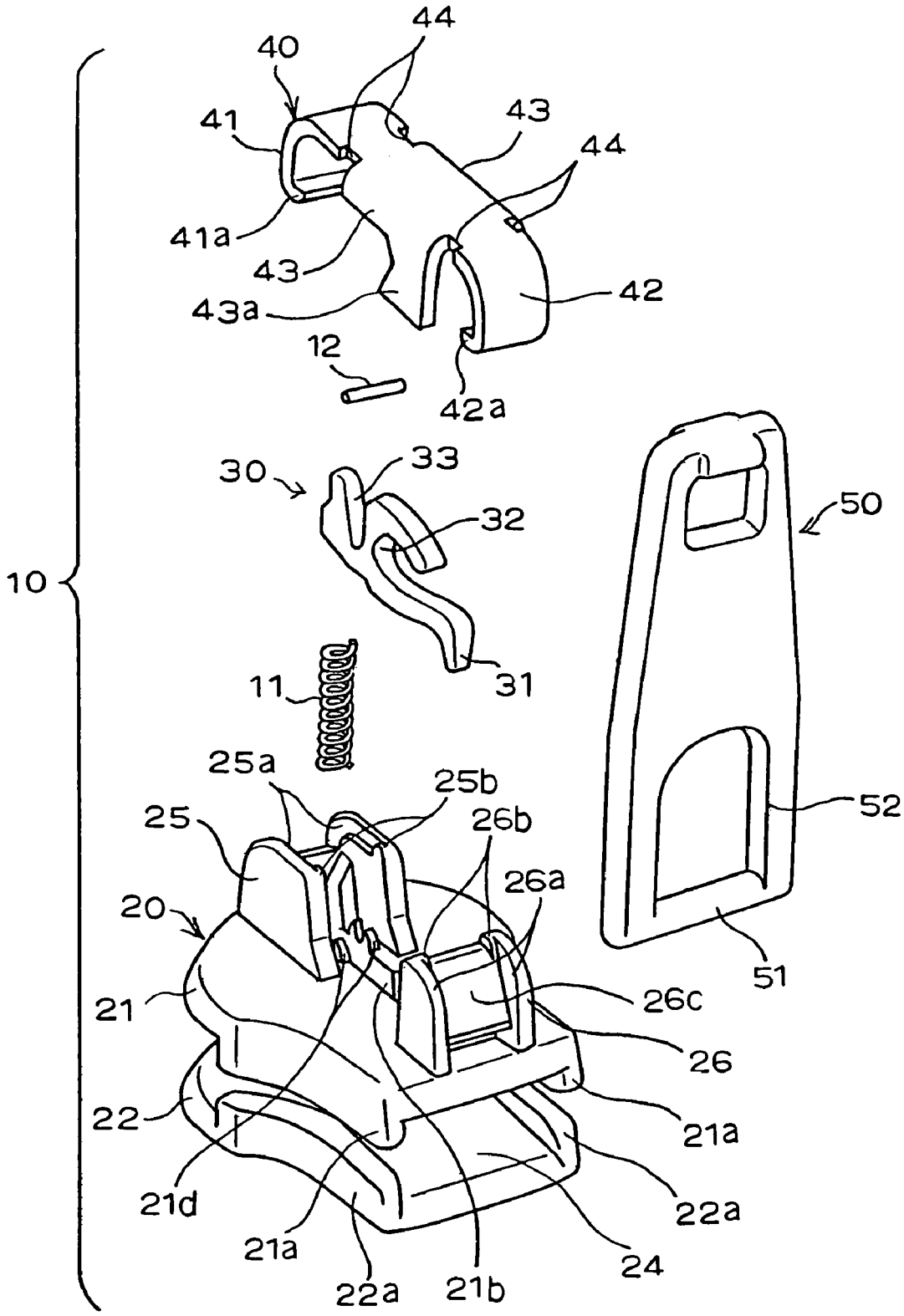
FIG. 10 is a perspective view showing a state in which components constituting a slider for a slide fastener with an automatic stopper of the present invention are disassembled (second embodiment)

Next, another structure example of the slider 10 mounting the pawl body 30 will be described with reference to FIGS. 10 to 15. FIGS. 10 to 15 show a second embodiment of the slider for the slide fastener with the automatic stopper of the present invention. FIG. 10 is a perspective view showing a state in which components constituting the slider are disassembled. FIGS. 11 to 14 are longitudinal sectional views showing assembly steps of the slider and FIG. 15 is a perspective view of the slider.

Figure 12:
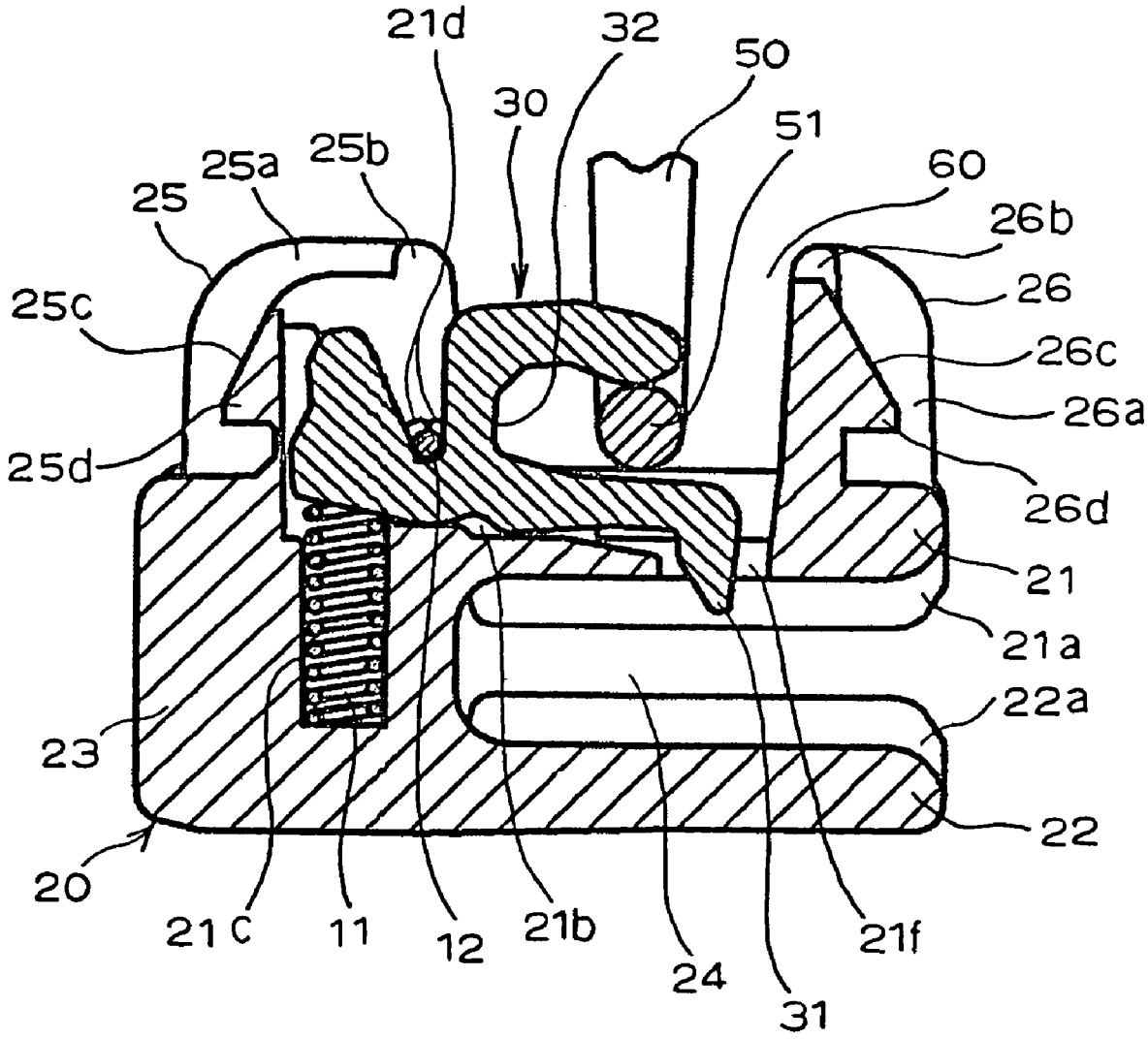
FIG. 12 is a longitudinal sectional view showing a next assembly step to that of FIG. 11 (second embodiment)

In these Figures, points largely different from the first embodiment is that, as shown in FIG. 12, a gap portion 60 for allowing the shaft portion 51 of the pull 50 to pass through is formed between the rear mounting pillar 26 formed integrally with the top face at the rear portion of the upper blade piece 21 of the slider body 20 so as to stand upright and the pawl body 30 mounted on the front portion of the top face of the upper blade piece 21 so as to swing vertically and that closing means for preventing the pull 50 from escaping out from the opening end of the concave portion 32 in the pawl body 30 by narrowing and closing a part of the gap portion 60 when the pull holding body 40 is engaged with the front and rear mounting pillars 25, 26 is constructed on each of the right and left wall portions (wing pieces) 43, 43 of the pull holding body 40.

Such components as the front mounting pillar 25, the pawl body 30, the pull 50, and the compression coil spring 11 are not different from the first embodiment except a part of structure of the slider body 20 shown in the drawings and the second embodiment is constructed of a similar structure. Thus, for the second embodiment, an upper blade piece 21 of the slider body 20, the rear mounting pillar 26 on a single side and a pull holding body 40 will be described specifically. In the meantime, identical member names and reference numerals are given to members substantially same as those of the first embodiment. Therefore, detailed description of these members is omitted.

A pair of front and rear mounting pillars 25, 26 are formed integrally on the top face of the upper blade piece 21 such that they stand upright for mounting the pull holding body 40 acting as a narrow transverse C shaped cover body, as shown in FIG. 10. This rear mounting pillar 26 comprises the rear supporting wall 26*a*, the projecting portion 26*b*, the step portion 26*c* and the engaging portions 26*d* like the first embodiment as shown in FIG. 11.

What is different from the rear mounting pillar 26 of the first embodiment is that the rear mounting pillar 26 is fixed integrally in a immobile condition on the top face at the rear portion of the upper blade piece 21. Further what is different from the rear mounting pillar 26 of the first embodiment is that a gap between the front face of the rear mounting pillar 26 and the pawl body 30 when mounting the pawl body 30 is expanded as shown in FIG. 12 by forming a front wall of the rear mounting pillar 26 into a substantially flat plane as shown in FIG. 11 without setting a length of the slider body 20 in back and forth directions unnecessarily longer. Therefore, an insertion of the shaft portion 51 of the pull 50 can be facilitated. Additionally, structures of the upper blade piece 21 of the slider body 20 and the rear mounting pillar 26 are simplified more than the first embodiment thereby leading to a further reduction in material cost, manufacturing cost and assembly cost.

Figure 11:
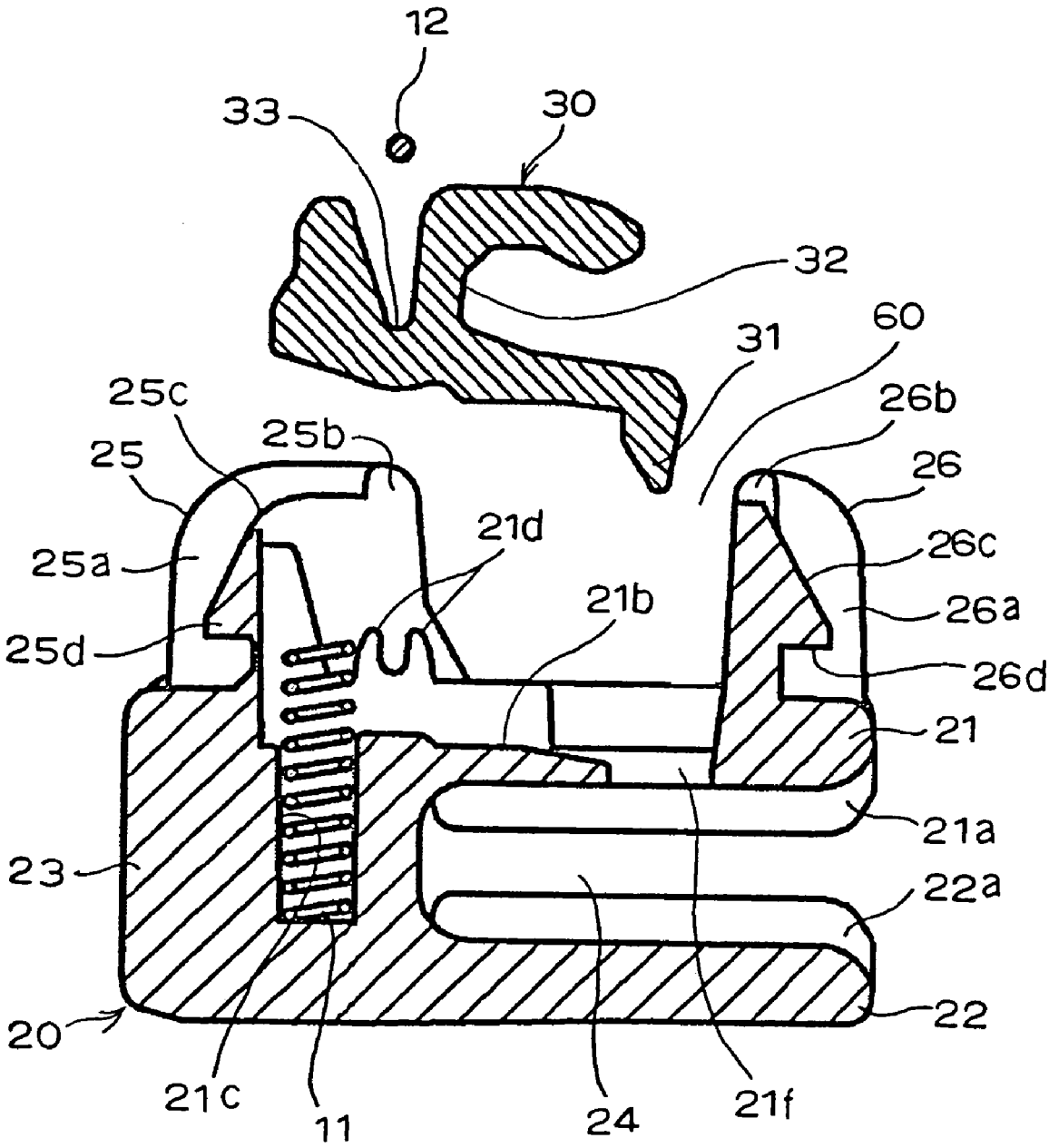
FIG. 11 is a longitudinal sectional view of major portions showing an assembly step of the same slider (second embodiment)

As shown in FIG. 11, the pawl body accommodating concave portion 21*b* extending from a rear base end of the front mounting pillar 25 to the rear mounting pillar 26 is formed as a placing face for the pawl body 30 in a central portion of the top face of the upper blade piece 21 without providing the pull guide pieces 21*e*. The spring accommodating hole 21*c* for the compression coil spring 11 is made in a center of a front end of a bottom face of the pawl body accommodating concave portion 21*b*. The rectangular pawl hole portion 21*f* which engages with/disengages from the pawl portion 31 of the pawl body 30 after the pawl body 30 is mounted is formed in a pierced manner adjacent to a front base end of the rear mounting pillar 26. This pawl hole portion 21*f* communicates with the engaging element guide path 24.

According to the second embodiment, a specified interval is set between the respective mounting pillars 25 and 26 as shown in FIG. 12 so as to form a sufficient space portion for accommodating a part of the shaft portion 51 of the pull 50 and the pawl body 30. Therefore, during an assembly process before the pull holding body 40 is engaged with the respective mounting pillars 25, 26 after the pawl body 30 is accommodated in the pawl body accommodating concave portion 21*b* in the upper blade piece 21, the gap portion 60 which allows the shaft portion 51 of the pull 50 to pass through can be secured sufficiently between the front face of the rear mounting pillar 26 and the opening end of the concave portion 32 in the pawl body 30.

Figure 13:
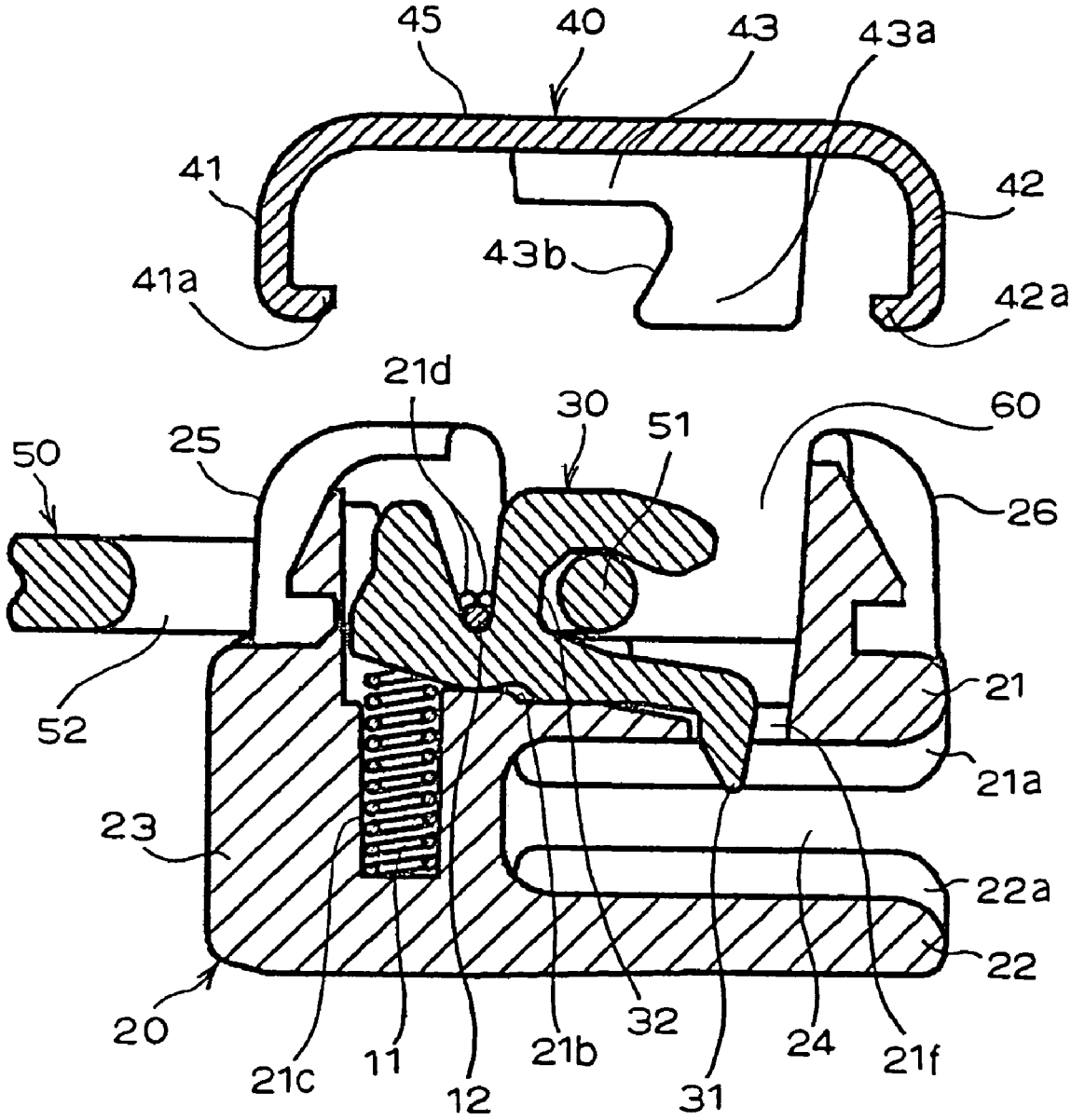
FIG. 13 is a longitudinal sectional view of major portions showing a next assembly step to that of FIG. 12 (second embodiment)
Figure 14:
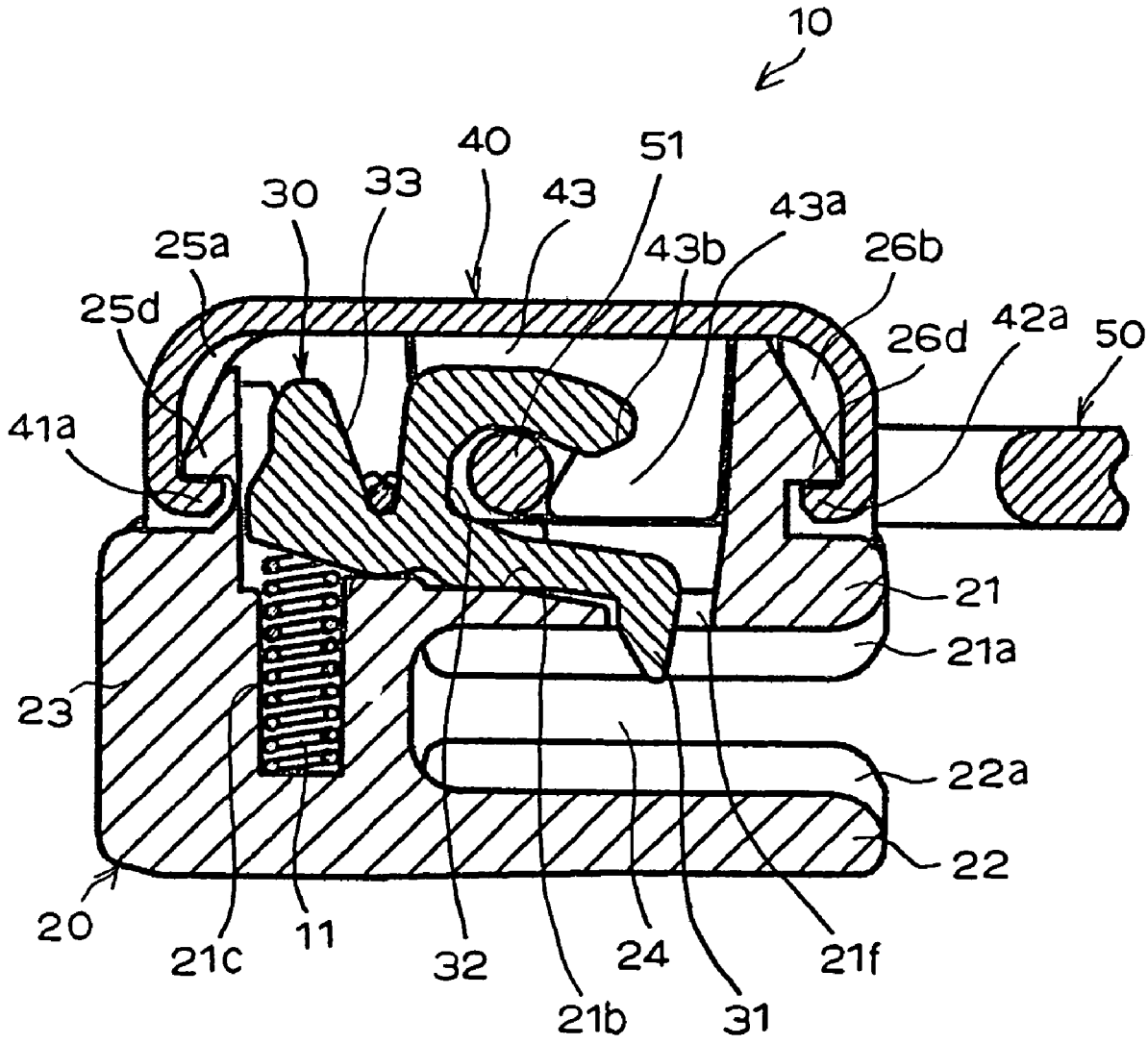
FIG. 14 is a longitudinal sectional view of major portions showing a next assembly step to that of FIG. 13 (second embodiment)
Figure 15:
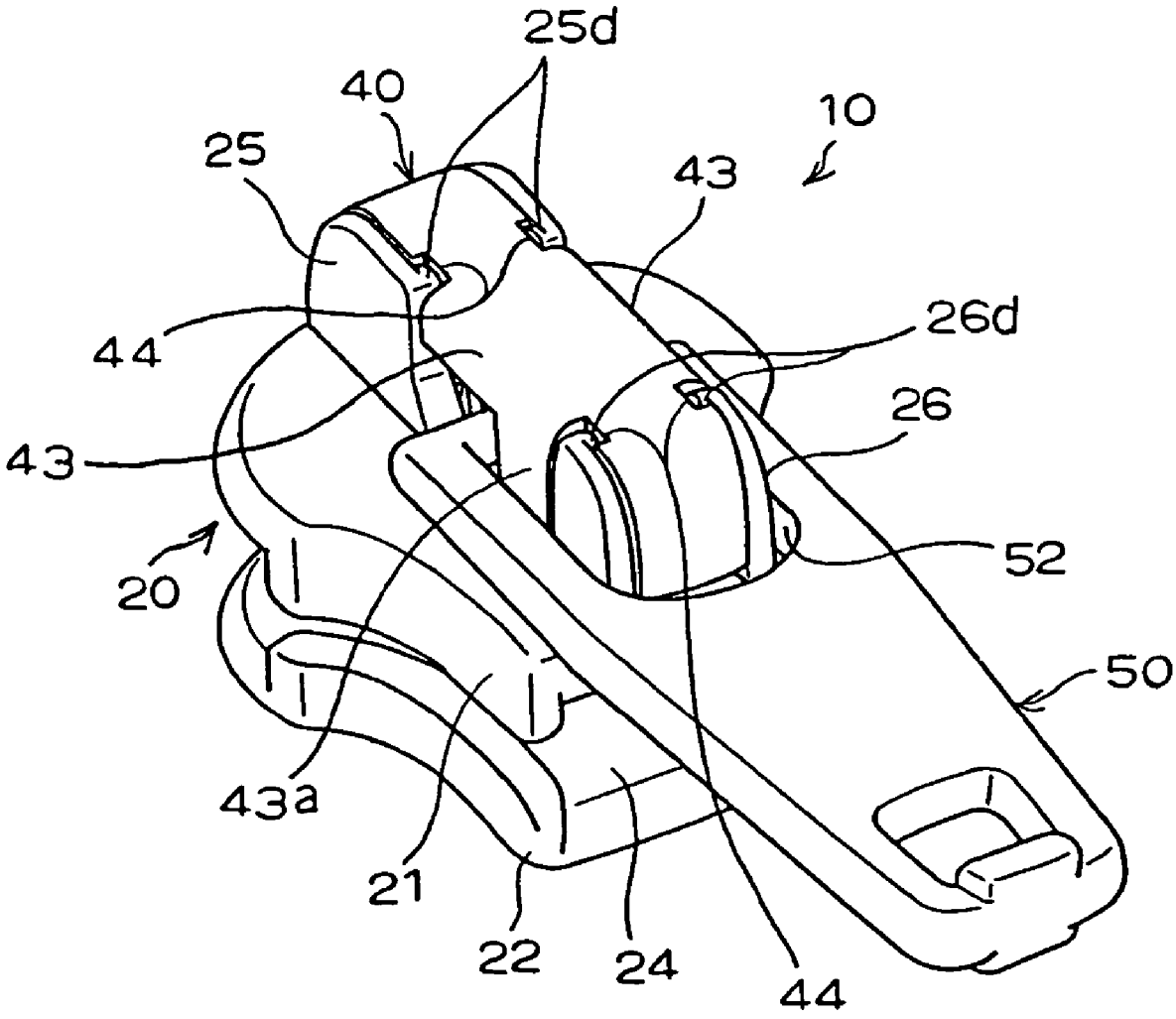
FIG. 15 is a perspective view of the same slider (second embodiment)

As shown in FIGS. 10 and 14, the pull holding body 40 has the right and left wing pieces 43, 43 for covering and shielding a part of the space portion between the front mounting pillar 25 and the rear mounting pillar 26. In the right and left wing pieces 43, 43, right and left side walls 43*a*, 43*a* extend downward as shown in FIGS. 10 and 13. A front end face of each of the right and left side walls 43*a* is formed as a pull guide face 43*b* for guiding the shaft portion 51 of the pull 50 by its smooth circular curve as shown in FIG. 13.

Existence of the pull guide face 43*b* enables the pull 50 to be guided from a front base end of the pull guide face 43*b* to the moving limit position of the pawl body 30 when the pull 50 is actuated. Thus, it is possible to exclude the pull guide pieces 21*e* projecting from the top face of the upper blade piece 21 as seen in the first embodiment. Because the pull guide pieces 21*e* on the upper blade piece 21 can be excluded, simplification in the slider structure and reductions in size and thickness thereof can be achieved.

As shown in FIG. 14, the right and left side walls 43*a* of the right and left wing pieces 43 can be constructed so as to cover and close the gap portion 60. The right and left wing pieces 43 can be formed in a substantially identical length to a distance between the front mounting pillar 25 and the rear mounting pillar 26 and further, front end portions of each of the right and left wing pieces 43 can be formed shorter than a vertical length of the wall portions 41, 42.

When the pull holding body 40 is engaged with the respective mounting pillars 25, 26, bottom end faces of the right and left wing pieces 43 are apart from the top face of the upper blade piece 21, forming a space portion which allows the shaft portion 51 of the pull 50 to move. The space surrounded by the rear face of the pull holding body 40 and the top face of the upper blade piece 21 turns to an operation space portion for operating the shaft portion 51 of the pull 50 and the pawl body 30 when the pull holding body 40 is engaged with the slider body 20.

According to the second embodiment, with the above-described structure, when the pull holding body 40 is engaged with the respective mounting pillars 25, 26 as shown in FIG. 14, the gap portion 60 can be covered and closed. Further, it is possible to construct the right and left wing pieces 43, 43 of the pull holding body 40 as the closing means which prevents the pull 50 from escaping from the opening end of the concave portion 32 in the pawl body 30.

Upon assembly of the slider 10 having the above-described structure, as shown in FIGS. 11 to 15, the assembly procedure for the compression coil spring 11, the pawl body 30 and the pull holding body 40 is not substantially different from that of the first embodiment. According to the structure of the slider 10 of the second embodiment, after the pawl body 30 is mounted on the top face of the upper blade piece 21 such that it is capable of swinging vertically, the shaft portion 51 of the pull 50 can be inserted into the gap portion 60 formed between the rear mounting pillar 26 and the pawl body 30 as shown in FIGS. 12 and 13. Consequently, the shaft portion 51 of the pull 50 can be inserted into the concave portion 32 in the pawl body 30 with the pawl body 30 placed and kept in a substantially vertical posture on the pawl body accommodating concave portion 21*b* of the upper blade piece 21. Next, the ring-like holding portion 52 of the pull 50 is inserted transversing the front mounting pillar 25 and the pull 50 is entirely placed in a substantially horizontal posture.

At this time, the gap portion 60 and the concave 32 in the pawl body 30 can secure a sufficient insertion space for the shaft portion 51 of the pull 50 without any interference by surrounding members as shown in FIGS. 12 and 13. For the reason, it is not necessary to move the pawl body 30 against an elastic force of the compression coil spring 11. Therefore, not only an assembly with an automatic assembly machine can be carried out, but also the assembly with man power can be achieved easily and securely as the first embodiment. Further, productivity can be increased, thereby reducing manufacturing cost.

Next, by a same operation as the first embodiment, the top wall portion of the pull holding body 40 is fitted to the front and rear mounting pillars 25, 26 such that it is accommodated inside the front and rear mounting pillars 25, 26 and the bottom end faces of the right and left wing pieces 43, 43 shield a part of the operation space portion for operating a part of the pull 50 and the pawl body 30 in a condition in which the bottom end faces thereof depart from the top face of the upper blade piece 21. Then, the right and left side walls 43*a* of the right and left wing pieces 43 cover and close the gap portion 60. Consequently, the assembly of the slider 10 is completed as shown in FIG. 15. In the meantime, operations for moving and stopping the slider 10 can be carried out by same operations as the first embodiment.

Third Embodiment

Figure 16:
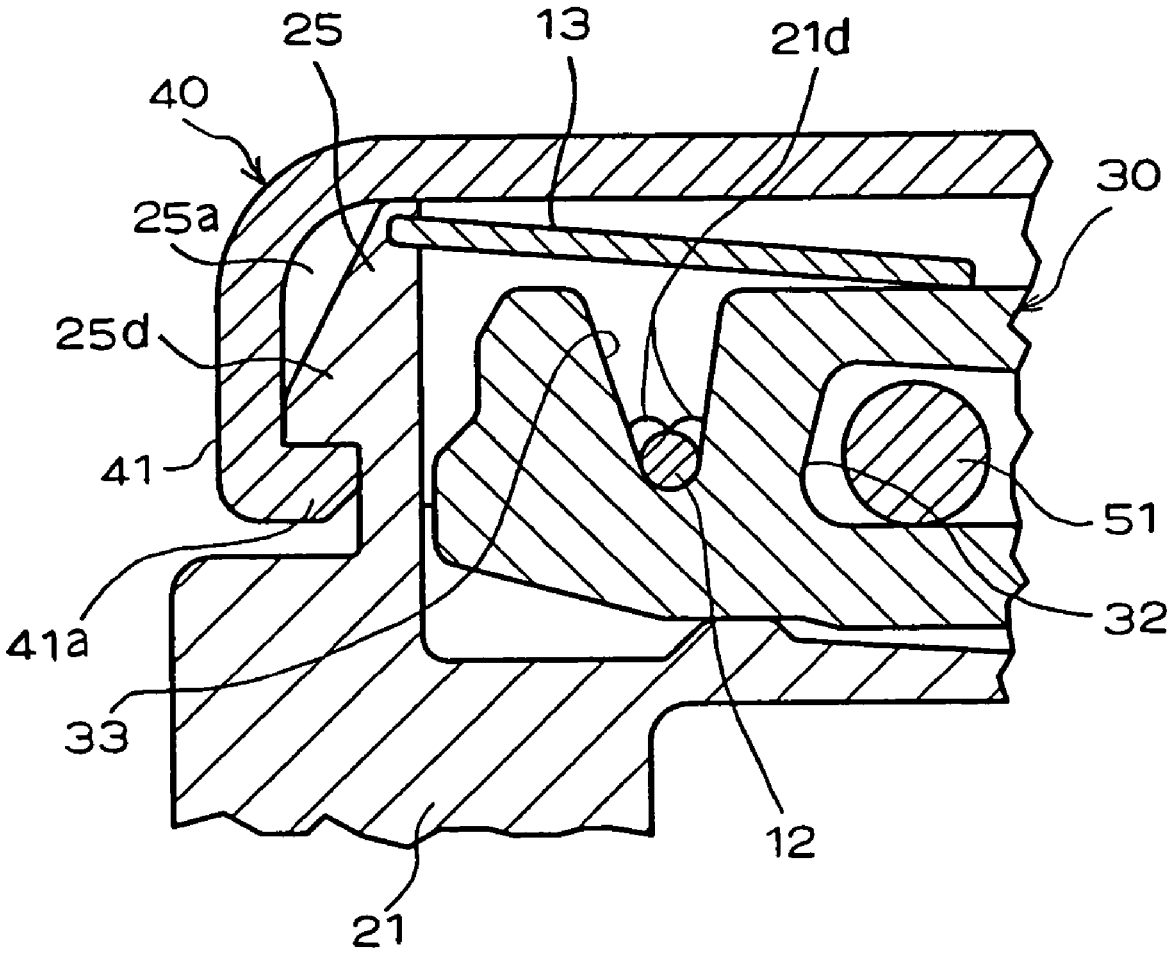
FIG. 16 is a longitudinal sectional view of major portions showing a modification of the same slider (third embodiment)
Figure 17:
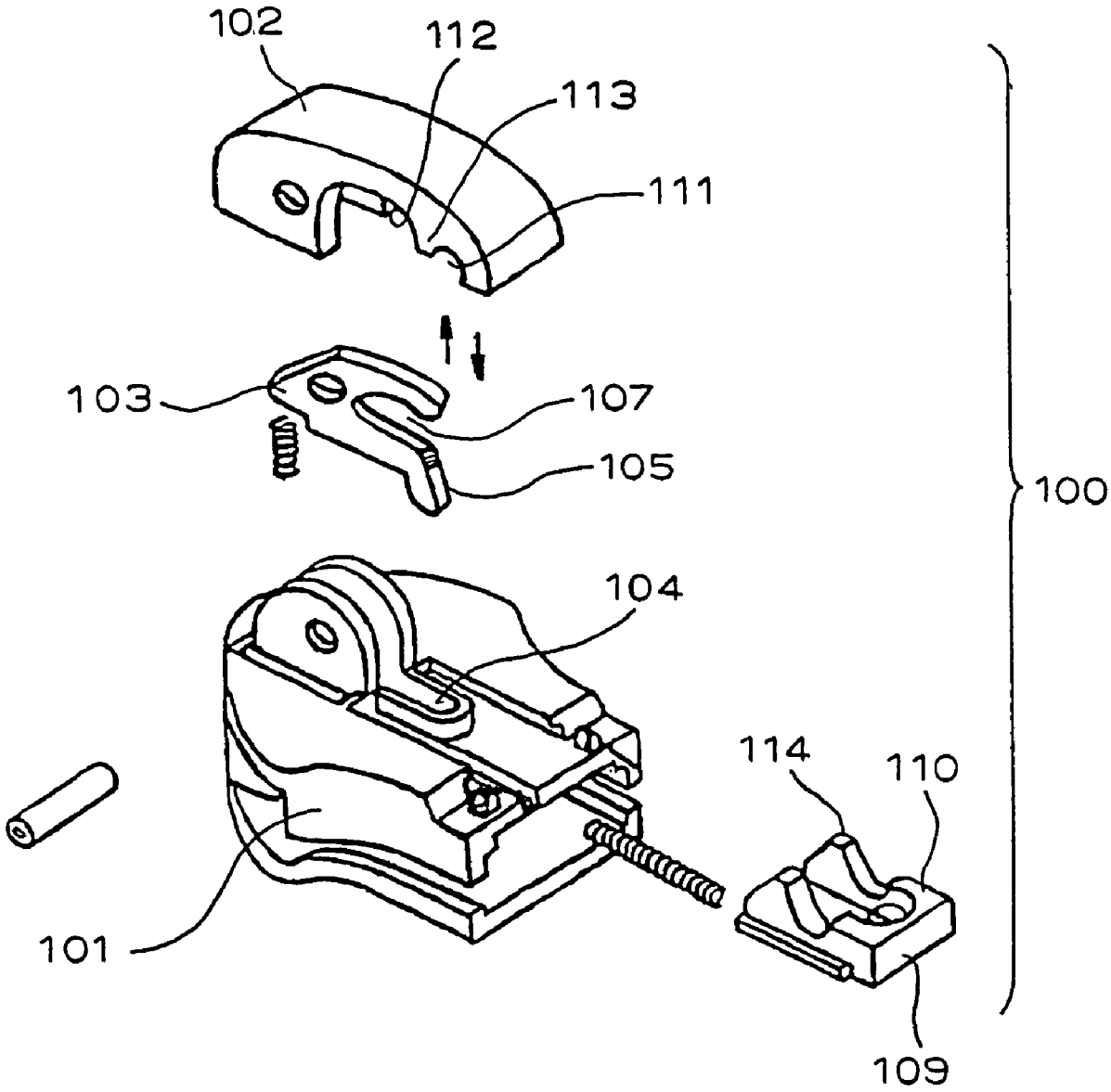
FIG. 17 PRIOR ART
FIG. 17 is an exploded perspective view of a conventional slider.
Figure 18:
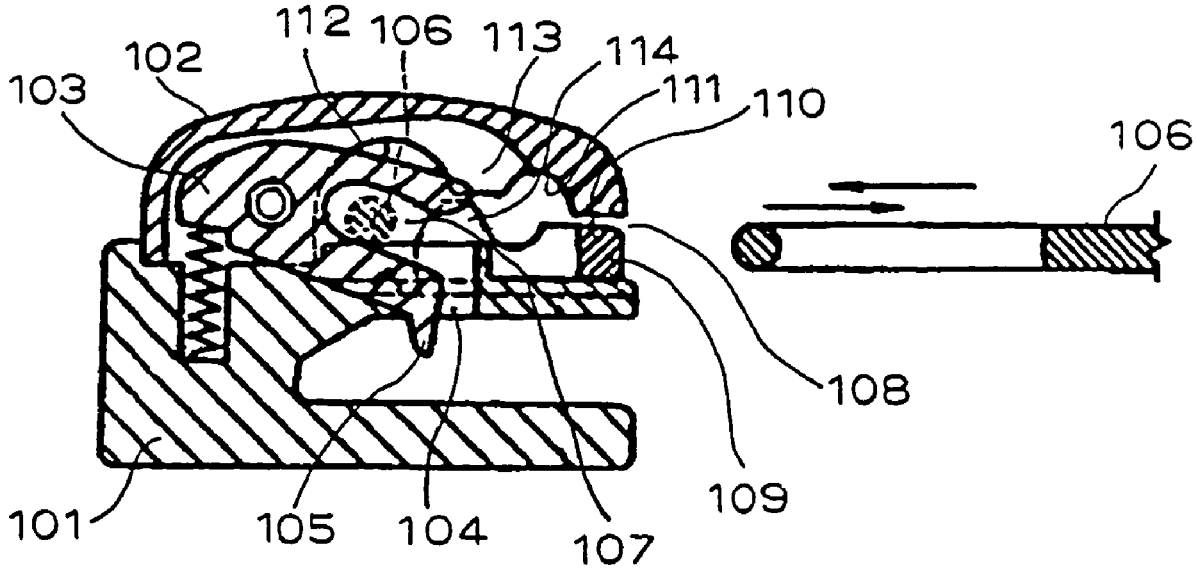
FIG. 18 PRIOR ART
FIG. 18 is a longitudinal sectional view of major portions for explaining an assembly step of the conventional slider.
Figure 19:
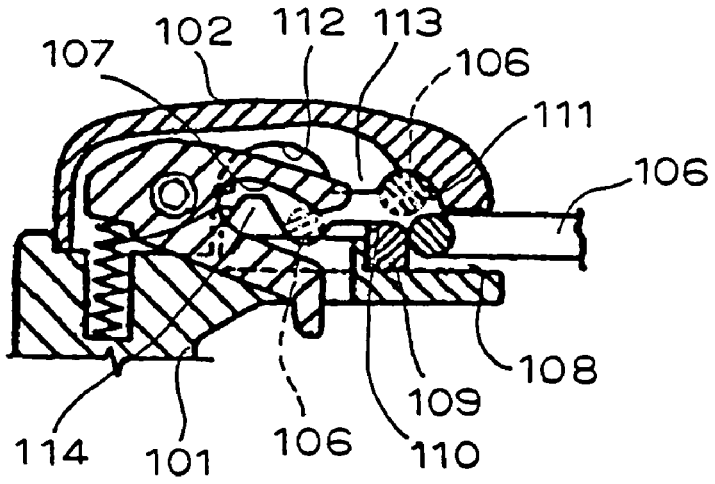
FIG. 19 PRIOR ART
FIG. 19 is a longitudinal sectional view of major portions for explaining an assembly step of the conventional slider.
Figure 20:
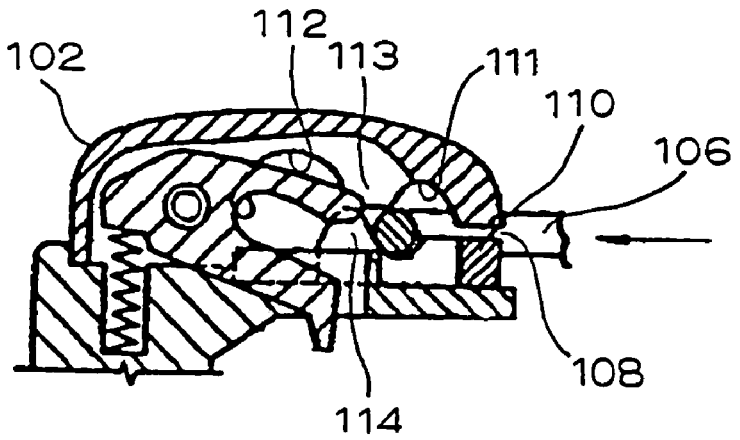
FIG. 20 PRIOR ART
FIG. 20 is a longitudinal sectional view of major portions for explaining an assembly step of the conventional slider.

FIG. 16 shows a third embodiment of the slider for the slide fastener with the automatic stopper of the present invention. Identical member names and reference numerals are given to substantially same members as the above-described embodiments. Therefore, a detailed description thereof is omitted.

In FIG. 16, the reference numeral 13 denotes a modification of a urging means for the pawl body 30 applied to the present invention. In the slider shown here, the spring accommodating hole 21*c* and the compression coil spring 11 accommodated in the spring accommodating hole 21*c* are excluded and an end portion of a leaf spring 13 is supported by a top portion of a front face of the front mounting pillar 25 in a cantilevered state while the bottom end of the same leaf spring 13 presses a top face of the pawl body 30. Consequently, the pawl portion 31 of the pawl body 30 can be always urged so as to project into the engaging element guide path 24 through the pawl hole portion 21*f* in the upper blade piece 21. If comparing with the above-described respective embodiments, although the third embodiment has same operations and effects as those of the respective embodiments, simplification of the slider structure and reductions in size and thickness can be achieved easily.

Although the pin 12 which supports the pawl body 30 rotatably is mounted in the pin supporting hole formed in the pawl body mounting portions 21*d*, 21*d* of the upper blade piece 21 and fixed on the top face of the upper blade piece 21 by crimping the pawl mounting portions 21*d* according to the respective embodiments, the present invention is not restricted to this example, and it can be fixed with conventionally known appropriate fixing means. For example, it is permissible to mount the pawl body 30 such that it is capable of swinging vertically by inserting the pin into a shaft hole provided in the front mounting pillar 26 and then fix the pin to the front mounting pillar 26 by crimping an exposed end portion of the pin.

The above description has exemplified preferred embodiments and modifications and the present invention is accomplished if the rear mounting pillar 26 and/or the pull holding body 40 has the gap portion 60 and the closing means. Thus, needless to say, the object of the present invention can be achieved sufficiently by setting a shape and a size of the rear mounting pillar 26 or the pull holding body 40 appropriately in relation with other factors such as shapes and sizes of other components. Thus, naturally, the present invention is not restricted to the above-described embodiments and modifications and may be modified in various ways within a scope of a protection of the present invention.

What is claimed is:

1. A slider for a slide fastener with an automatic stopper comprising:

a slider body for engaging/disengaging a zip teeth row of a fastener chain;

a pair of a front mounting pillar and a rear mounting pillar provided on a top face of the slider body;

a pawl body which is mounted on the top face of the slider body such that it is capable of swinging vertically and engages with and disengaged from a part of the zip teeth row in the fastener chain through an inside of the slider body;

a concave portion which is formed in the pawl body and opened to the rear mounting pillar for accommodating a shaft portion of a pull;

a pull holding body which engages with the front and rear mounting pillars;

engaging portions provided on the front and rear mounting pillars respectively; and engaged portions to be respectively engaged with the engaging portions provided on the pull holding body, wherein a gap portion which allows the shaft portion of the pull to pass through is formed between an opening end of the concave portion and the rear mounting pillar, closing means for closing a part of the gap portion and preventing the pull from escaping from the opening end of the concave portion is provided at the front and rear mounting pillars or the pull holding body, and the closing means comprises the rear mounting pillar, and the rear mounting pillar is disposed slidably to the opening end of the concave portion and closes the gap portion at a position close to the opening end of the concave portion while a positioning portion for positioning the rear mounting pillar at the position close to the opening end is formed on the slider body.

2. The slider for the slide fastener with the automatic stopper according to claim 1, wherein the pair of the front mounting pillar and the rear mounting pillar and the pull holding body have lateral moving preventing means for preventing the pull holding body from moving in right and left directions relative to the slider body, and the lateral moving preventing means comprises supporting walls erected on right and left edges of the pair of the mounting pillars and wall portions of the pull holding body fit and supported among the right and left supporting walls.

3. The slider for the slide fastener with the automatic stopper according to claim 1, wherein a fitting guide groove for guiding the rear mounting pillar in its fitting condition is formed in a top face of the slider body while fitting portions which are fit into the fitting guide groove are formed on the rear mounting pillar.

4. A slider for a slide fastener with an automatic stopper comprising:

a slider body for engaging/disengaging a zip teeth row of a fastener chain;

a pair of a front mounting pillar and a rear mounting pillar provided on a top face of the slider body;

a pawl body which is mounted on the top face of the slider body such that it is capable of swinging vertically and engaged with and disengages from a part of the zip teeth row in the fastener chain through an inside of the slider body;

a concave portion which is formed in the pawl body and opened to rear the mounting pillar for accommodating a shaft portion of a pull;

a pull holding body which engages with the front and rear mounting pillars;

engaging portions provided on the front and rear mounting pillars respectively; and engaged portions to be respectively engaged with the engaging portions provided on the pull holding body, wherein a gap portion which allows the shaft portion of the pull to pass through is formed between an opening end of the concave portion and the rear mounting pillar, and closing means for closing a part of the gap portion and preventing the pull from escaping from the opening end of the concave portion is provided at the front and rear mounting pillars or the pull holding body, and the closing means comprises right and left wall portions projecting downward from the pull holding body and when the pull holding body is engaged with the pair of the mounting pillars, the right and left wall portions cover and close the gap portion.

5. The slider for the slide fastener with the automatic stopper according to claim 4, wherein the pull holding body comprises the wall portions wherein front and rear wall portions extend from front and rear ends of a top wall potion, and the front and rear wall portions comprise the engaged portions.

6. The slider for the slide fastener with the automatic stopper according to claim 4, wherein pull guide faces for guiding a shaft portion of the pull are formed besides the right and left wall portions respectively.

* * * * *